US005605249A

United States Patent [19]

Gonyea

[11] Patent Number: 5,605,249

[45] Date of Patent: Feb. 25, 1997

[54] BATTERY OPERATED VENDING MACHINE HAVING A CAROUSEL STACKING ARRANGEMENT AND PLUNGER-TYPE DISPENSER

[76] Inventor: Gerald Gonyea, 9 Missouri Ave., Potsdam, N.Y. 13676

[21] Appl. No.: 354,478

[22] Filed: Dec. 12, 1994

[51] Int. Cl.[6] ..... G07F 11/00

[52] U.S. Cl. ..... 221/6; 221/11; 221/17; 221/97; 221/258; 221/121; 221/275

[58] Field of Search ..... 221/1, 2, 6, 14, 221/103, 105, 97, 197, 268, 270, 271, 281; 194/205, 219, 346

[56] References Cited

U.S. PATENT DOCUMENTS

| | | | |
|---|---|---|---|
| 364,028 | 5/1887 | MacBeth . | |
| 480,018 | 8/1892 | Hunter | 221/270 X |
| 937,820 | 10/1909 | Ladue . | |
| 1,699,476 | 1/1929 | Morin | 221/281 X |
| 2,099,267 | 11/1937 | Hackett | 221/271 X |
| 2,378,284 | 6/1945 | Burge | 221/281 X |
| 2,394,262 | 2/1946 | Reifsnyder | 221/281 X |
| 3,179,289 | 4/1965 | Moyer et al. | 221/121 |
| 3,410,385 | 11/1968 | Freet et al. | 194/39 |
| 4,109,825 | 8/1978 | Weitzman | 221/14 |
| 4,301,909 | 11/1981 | Snavely | 194/2 |
| 4,526,264 | 7/1985 | MacNamara et al. | 194/1 |
| 4,872,591 | 10/1989 | Konopka | 221/3 |
| 5,152,422 | 10/1992 | Springer | 221/2 |
| 5,172,828 | 12/1992 | Ficken et al. | 221/105 X |
| 5,316,124 | 5/1994 | Barnes et al. | 194/206 |

FOREIGN PATENT DOCUMENTS

| | | | |
|---|---|---|---|
| 3273469 | 12/1991 | Japan | 221/197 X |

*Primary Examiner*—William E. Terrell
*Assistant Examiner*—Khoi H. Tran
*Attorney, Agent, or Firm*—Troutman Sanders LLP; Joel S. Goldman, Esq.

[57] ABSTRACT

A miniature, battery operated vending machine for dispensing products includes a rotating carousel for holding stacks of products and a plunger assembly for dispensing products from the carousel into a dispensing area. A plurality of columns are disposed along a circumference of the carousel. A carousel rotation device aligns a column with the plunger mechanism. The plunger mechanism dispenses product from a column until the column is depleted of products. A controller senses product depletion and rotates the carousel to align another column with the plunger assembly. After all products have been dispensed, the controller blocks a coin insertion slot, displays a "sold-out" sign, and shuts the machine off. The vending machine also includes a device for allowing refilling of the carousel and a device for resetting the coin slot and "sold-out" sign. The vending machine also incluces a separate currency slot for accepting donations.

21 Claims, 14 Drawing Sheets

MATCH LINE TO FIG 7B

MATCH LINE FROM FIG 7B

BATTERY OPERATED VENDING MACHINE HAVING A CAROUSEL STACKING ARRANGEMENT AND PLUNGER-TYPE DISPENSER

BACKGROUND OF THE INVENTION

1. Technical Field

This invention relates generally to vending machines, and more particularly, to a miniature, battery operated, microprocessor controlled vending machine.

2. Description of the Prior Art

Various dispensing devices which include rotating carousels containing stacks of products to be dispensed have been developed in recent years. For example, U.S. Pat. No. 4,109,825 issued to Weitzman discloses a vending machine including aselector handle for manually rotating a compartmental member or carousel through a gear network for selection of a particular product, and a rotary handle for manually dispensing product from a particular column.

Additionally, U.S. Pat. No. 5,125,422, issued to Springer (the "Springer patent"), discloses a dispenser for dispensing pill packages in a predetermined sequential order. Specifically, the Springer patent discloses a manual handle which dispenses pills by engaging a pill cup through engagement members. A timed and motorized unit rotates the carousel through each of its columns and allows a user to dispense pills from each carousel column depending upon the time of day. Finally, U.S. Pat. Nos. 3,179,289, 3,410,385, and 364,028 also disclose vending machines including manually operated carousels and manually operated dispensing mechanisms.

There are several disadvantages associated with prior art carousel-type dispensing devices. First, many rotary carousel dispensing devices require manual operation. Depending upon the vending machine size, those who have little hand strength find it difficult to operate such vending machines. Consumers and vending machine operators generally desire electronically actuated machines over manually operated machines since electronic machines usually accept a wide variety of coins and paper currency, electronic machines have a more modern appearance, and electronic machines utilize easy-to-operate selection buttons. However, electronic vending machines usually require a standard electrical outlet for power to operate dispensing mechanisms and currency recognition devices. This power requirement limits the locations in which they may be placed, and therefore limits the market share of such machines.

SUMMARY OF THE INVENTION

The present invention recognizes and addresses the foregoing disadvantages, and others of prior art constructions and methods.

Accordingly, it is an object of the present invention to provide a reliable, easily operated vending machine which requires little maintenance other than periodic refilling with product packages.

Still another object of present invention is to provide a vending machine which having a small "foot-print" as compared to standard-sized vending machines, such that a vending machine according to the present invention may easily be displayed on a store counter near a cash register to insure maximum exposure to potential consumers.

It is another object of the present vending machine to provide a vending machine in which dispensing components and control electronics occupy as little internal volume as possible with respect to internal volume for storing product packages.

It is another object of the present invention to provide a vending machine which is operable in virtually any location, regardless of the availability of standard electrical outlets.

It is another object of the present invention to provide a vending machine which includes a currency donation slot which is separate from a currency slot for purchasing merchandise, wherein the currency donation slot may accept donations for a charitable cause other nonprofit legal entity.

It is another object of the present invention to provide a vending machine which includes a donation slot having a donation currency bin attached thereto, and separate from a merchandise currency bin, wherein the donation currency bin is secure and lockable.

It is another object of the present invention to provide a battery powered, microprocessor controlled vending machine for automatic control of dispensing product packages.

Finally, another object of the present invention is to provide a vending machine which utilizes as little power as possible during operation and between dispensing cycles.

Generally speaking, the invention relates to a miniature vending machine for dispensing packaged products. According to the present invention, the vending machine includes a frame, a carousel rotatably attached to the frame, a plurality of columns arranged circumferentially around the carousel for storing stacks of packaged products, and means for dispensing the product packages from each column of the carousel.

More specifically, the vending machine according to the present invention includes a carousel having plurality of column compartments arranged along its circumference. The carousel may be rotatably mounted to a frame for proper support. Each column within the carousel stores a stack of product packages within the vending machine.

The vending machine frame or chassis may also include a base which rotatably supports a bottom portion of the carousel. The base also houses a reciprocating plunger assembly. The plunger assembly horizontally displaces a bottom-most product package of a stack within a column of the carousel which is aligned with the plunger assembly. The plunger assembly may include a plunger for displacing the product package, a motion imparting means such as a motor or solenoid for activating the plunger, and a gear set or an appropriate mechanical linkage for mechanically coupling the motion imparting means to the plunger.

In a preferred embodiment of the present invention, the base includes all dispensing mechanisms and control electronics, thereby reserving as much remaining volume as possible within the vending machine for the storage of product packages.

In the preferred embodiment, a center portion of the vending machine base houses the plunger assembly, and the plunger assembly includes an electric motor and gear set for imparting motion to the plunger. Additionally, a top surface of the base includes a recess extending between a front edge of the base and a center portion of the base. The plunger reciprocates within the recess to displace product packages from a column which is circumferentially aligned with the plunger assembly on the base. Furthermore, a top surface of the plunger is flush with a top surface of the base, such that a top surface of the base and the top plunger surface form a continuous flat surface around an outer periphery of the base.

In the preferred embodiment, each column within the carousel includes an open bottom portion which allows the each product package stack housed therein to rest on the base top surface or plunger top surface, depending on circumferential placement of a each column with respect to the top base surface. For example, only one carousel column is circumferentially aligned with the plunger top surface such that its stack of product packages rests on the plunger surface. The remaining stacks which occupy other columns rest on the base surface.

The plunger assembly dispenses a product by retracting radially inward of a product stack resting upon the plunger surface. The plunger retracts radially inward and exposes the base recess, which allows the product stack to drop into the recess. The recess depth and plunger height is approximately equal to the product package height. After the stack drops into the recess, the plunger moves radially outward from the base center portion and engages the lowest product package in the stack.

The plunger then displaces the lowest product package from underneath the stack, outward from beneath an outer wall of the column which houses the stack, and into a dispensing area for access by a consumer. The stack then comes to rest on the top surface of the plunger in its forward-most and original position.

The retraction and displacement movement of the plunger comprises a single displacement cycle, with a resting position of the plunger remaining in a forward-most portion between product dispensing cycles. This resting position prevents piferage of products within the vending machine and eliminates the need for separate anti-theft components, which allows greater room for essential dispensing components and product package storage within the vending machine.

After vending machine dispenses all product from a single column, it then rotates the carousel using any appropriate means to align another column over the plunger top surface. The vending machine depletes all product in a single column before moving another column over the plunger surface.

The vending machine according to the present invention also includes a coin slot for accepting currency for products, a separate donation coin slot for accepting donations, a currency sign for display the product price while the machine contains product, and a "sold-out" sign for indicating that all of the product packages have been depleted.

Additionally, a preferred embodiment of the present invention includes an outer housing for protecting the carousel and products stored therein, a front door hingedly attached to the housing for access to the carousel, and means for advancing the carousel for reloading product packages into the column. Additionally, the preferred embodiment utilizes the power of batteries for actuation of the plunger assembly and rotation of the carousel. Therefore, a battery mounting means mounts the batteries near the front door for easy access by a maintenance technician when battery replacement is needed.

Additionally, the front housing door may also include a transparent panel for accepting display panels. The display panels may include product advertising, or advertising for non-profit organizations for donation purposes.

The preferred embodiment of the present invention also includes control means for controlling the plunger assembly and carousel rotation in response to currency deposited from a consumer. Specifically, the vending machine includes a currency sensor disposed near the coin slot in vending machine front door. When a consumer deposits the correct amount of currency into the vending machine, a dispense signal is sent to the control means. More specifically, the currency sensor may be of any type, including one for sensing paper currency, however the present invention utilizes a microswitch which complete a circuit when a consumer inserts a predetermined amount of change.

In addition to accepting individual product packages, the columns may also accept cartridges which contain a complete stack of products. Furthermore, both the columns or insertion cartridges may accept a package of any shape, including sperical-, tetrahedron-, and cylindrical-shaped packages.

The control means, preferably a microcontroller, is responsive to the dispense signal for activating the plunger assembly. Thus, when a consumer inserts the correct amount of change through the slot, the microswitch signals the microcontroller to initiate a product dispense cycle. As explained above, during a product dispense cycle, the plunger assembly dispenses a product package for access by the consumer.

After the control means completes a product dispense cycle, it checks for product depletion in the column positioned above the plunger assembly. In a preferred embodiment, a depletion sensor may include a microswitch on the plunger surface. Thus, when product packages remain in the column aligned with the plunger, the switch remains closed in a first state indicating to the microcontroller that product remains in the column. If the column is empty, the microswitch opens into a second state and indicates to the microcontroller that the column is empty.

Therefore, according to a preferred embodiment of the present invention, the control means samples the microswitch state after plunger assembly activation. If the microcontroller samples the first microswitch state, the microcontroller deactivates the vending machine until another dispense signal is received. If the microcontroller samples the second microswitch state, the microcontroller initiates a column rotation sequence.

A column rotation sequence includes activating the carousel motor to rotate the carousel and align another column with the plunger assembly. In a preferred embodiment, the base portion of the vending machine also includes a motor for rotating the carousel through a gear and cam set, or other appropriate means. Thus, during a column rotation sequence, the microcontroller activates the motor to rotate the carousel to align another column over the plunger. After a column rotation sequence, the microcontroller samples the microswitch state again. If microcontroller samples the first microswitch state, then it deactivates the vending machine until a dispense signal is received.

After a predetermined number of column rotation sequences, the microcontroller deactivates the vending machine. For example, the predetermined number of column rotations should equal the number of columns in the carousel. Therefore, if a total of six columns exist and the microcontroller rotates the carousel to align a circumferentially adjacent column with the plunger after depletion of a previous column, a total of six rotation sequences indicates that the entire carousel is empty.

Therefore, after performing a number of carousel rotation sequences equal to the number of columns in the carousel, then the control means may shut down the vending machine until a technician refills the carousel. During a shut down sequence the microcontroller may activate means for blocking the coin slot, activate means for changing a currency sign to a "sold-out" sign, and deactivate vending machine until it is refilled to conserve battery power.

According to a preferred embodiment of the present invention, the microcontroller may also initiate a shut-down sequence when the machine malfunctions. For example, if the carousel becomes jammed within the vending machine housing, the microcontroller may sense a power surge within the carousel motor and initiate the shut-down sequence. Similarly, the microcontroller may initiate a shut-down sequence if the plunger becomes jammed, or if the batteries become weak.

Finally, according to a preferred embodiment of the present invention, the vending machine includes means for allowing a technician to access each of the columns for refilling purposes, and means for resetting the coin slot, "sold-out" sign, and currency sign.

Other objects, features and aspects of the present invention are discussed in greater detail below.

BRIEF DESCRIPTION OF THE DRAWINGS

The accompanying drawings illustrate the preferred embodiment of the invention, and serve to aid in the explanation of the principles of the invention.

DETAILED DESCRIPTION OF THE INVENTION

Mechanical Layout

Figure 1:
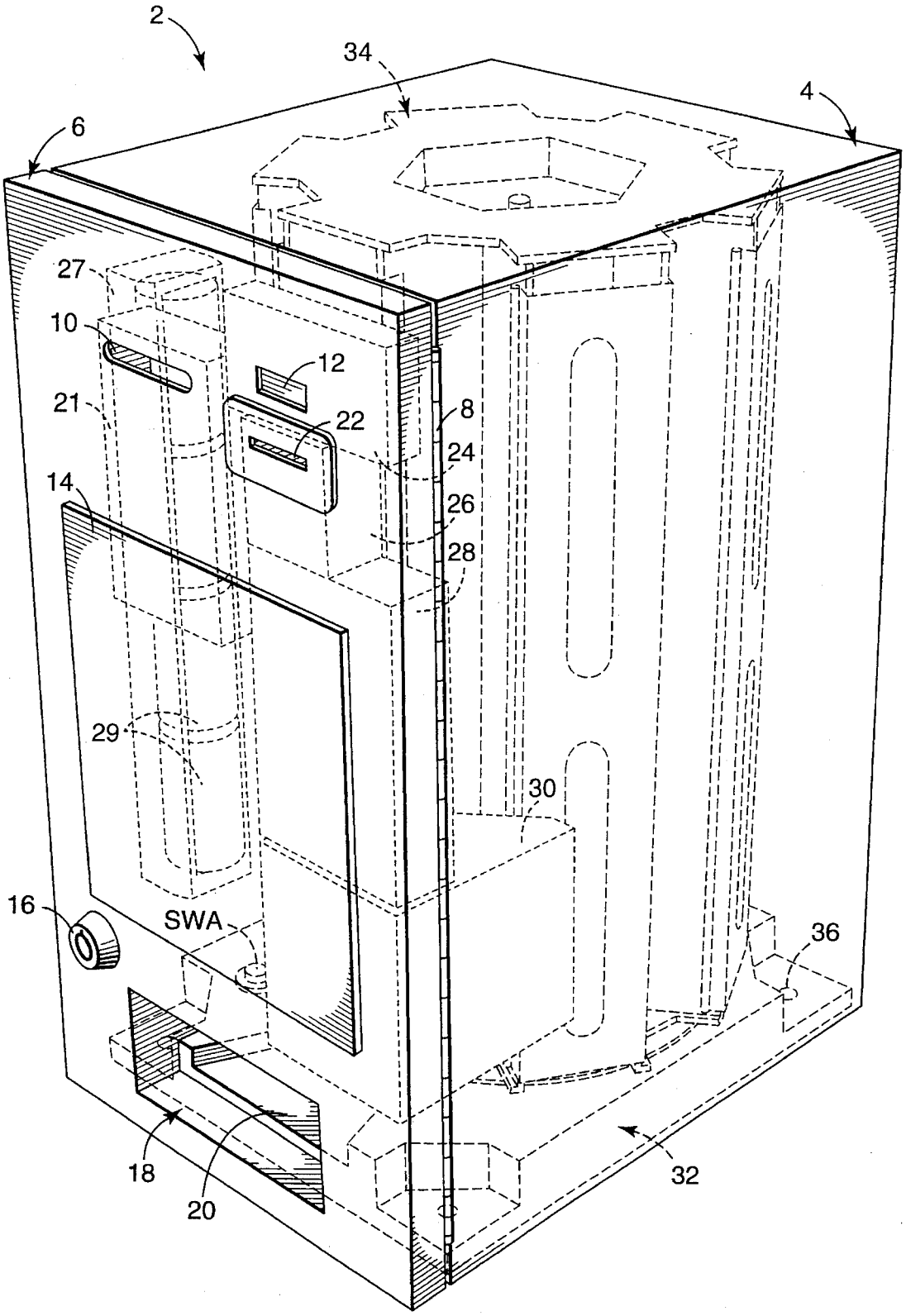
FIG. 1 illustrates a perspective view of the vending machine according to the present invention with an interior portion of the vending machine generally represented by hidden lines.

FIG. 1 illustrates the inventive vending machine which is generally indicated by reference numeral 2. Vending machine 2 includes an outer housing 4 which is preferably fabricated from sheet metal, or any other suitable material for housing inner portions of the vending machine. Housing 4 includes a front panel 6 rotatably attached to the cover by hinge 8. Front panel 6 allows easy access to inner portions of vending machine 2 for refilling product packages, installation, and routine maintenance, as is explained in further detail below. A lock mechanism 16 also allows a technician to access the vending machine interior while providing adequate security against vandals and thieves. Additionally, front panel 6 may include an area 14 which displays product advertising material or other material which advertises a charitable cause for a not-for-profit organization or some other legal nonprofit entity which desires donation in slot 10. Specifically, area 14 may comprise a transparent panel portion which accepts a card therebehind for display purposes.

Front panel 6 also includes a merchandise coin slot 22 for accepting currency in exchange for a product package dispensed by the vending machine. Additionally, the vending machine includes a currency/"sold-out" sign space 12 for displaying a currency sign when the machine contains product packages, and for displaying a "sold-out" sign when the machine has depleted its product package supply. For those who wish to donate money to a charitable cause, front panel 6 includes currency donation slot 10 and a separate donation coin bin 21 when the machine is used for raising donations for charitable causes. The donation bin is lockable for accounting purposes.

Figure 6:
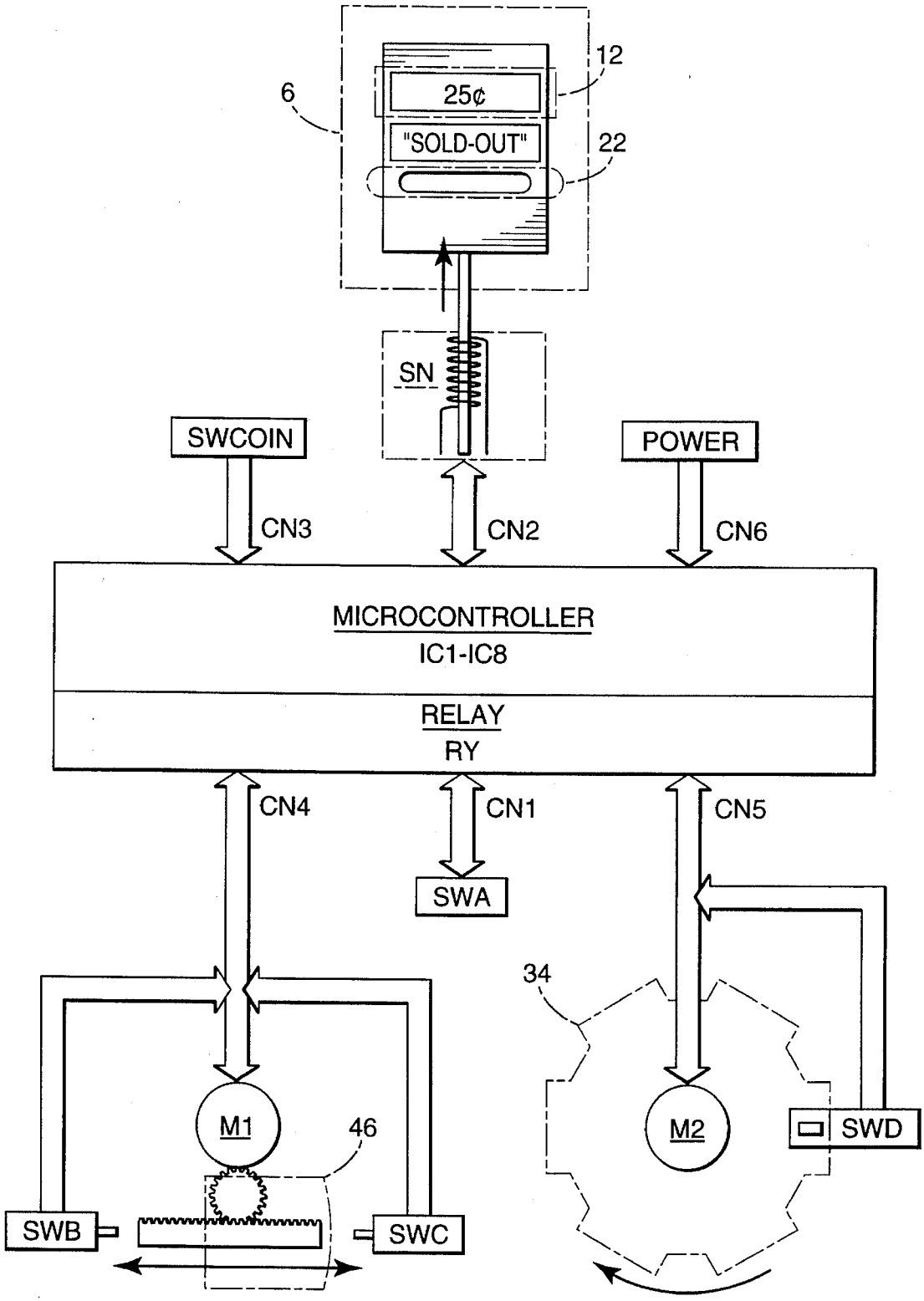
FIG. 6 illustrates a functional circuit block diagram for the electronic portions of the inventive vending machine.

Hidden lines in FIG. 1 illustrate a sign actuator 24 beneath the sign space 12. As explained in further detail below, when the vending machine depletes its product package supply or malfunctions while attempting to dispense an item, sign actuator 24 changes the sign from displaying the required currency to a "sold-out" sign, and also actuates a merchandise coin slot blocker, as seen in FIG. 6, to cover merchandise coin slot 22.

Hidden lines in FIG. 1 also illustrated mechanical coin sorting mechanisms 26 and 28 which detect when an appropriate amount of currency has been inserted into the vending machine for purchasing a product package. Hidden lines in FIG. 1 also illustrate a coin bin 30 which receives all coins passing through the coin sorting mechanisms 26 and 28. As explained in further detail below, the coin sorting mechanisms may depress a microswitch or trip an optical device which activates the vending machine to dispense a packaged product onto recess surface 20 in dispensing area 18 for a consumer.

Additionally, FIG. 1 illustrates in hidden lines a battery pack 27 for holding a plurality of battery cells 29 which provide power to the vending machine during dispensing and carousel rotation cycles. FIG. 1 also illustrates a carousel 34 for storing product packages. Base portion 32 rotatably supports the carousel and the stacks of product packages stored therein, as is explained in greater detail below. Finally, in the interest of preventing machine theft, recesses in corners of base portion 32 include mounting holes 36 for fastening the vending machine to a surface.

Although vending machine 2 may be any size appropriate for the type of package to be dispensed, a preferred embodiment of machine includes an overall housing size having a width of approximately 203 millimeters (mm), a height of approximately 365 mm, and a depth of approximately 260 mm, and preferably dispenses a package having a width of 45 mm, a depth of 45 mm, and a height of 13 mm. On the power of four (4) 1.5 volt "size D" battery cells, the preferred embodiment of the vending machine 2 may dispense approximately 6,000 product packages which weigh twenty five (25) grams or less per package. The preferred vending machine size allows for display on cash register counters and other high exposure areas for maximum exposure to potential consumers.

Figure 2:
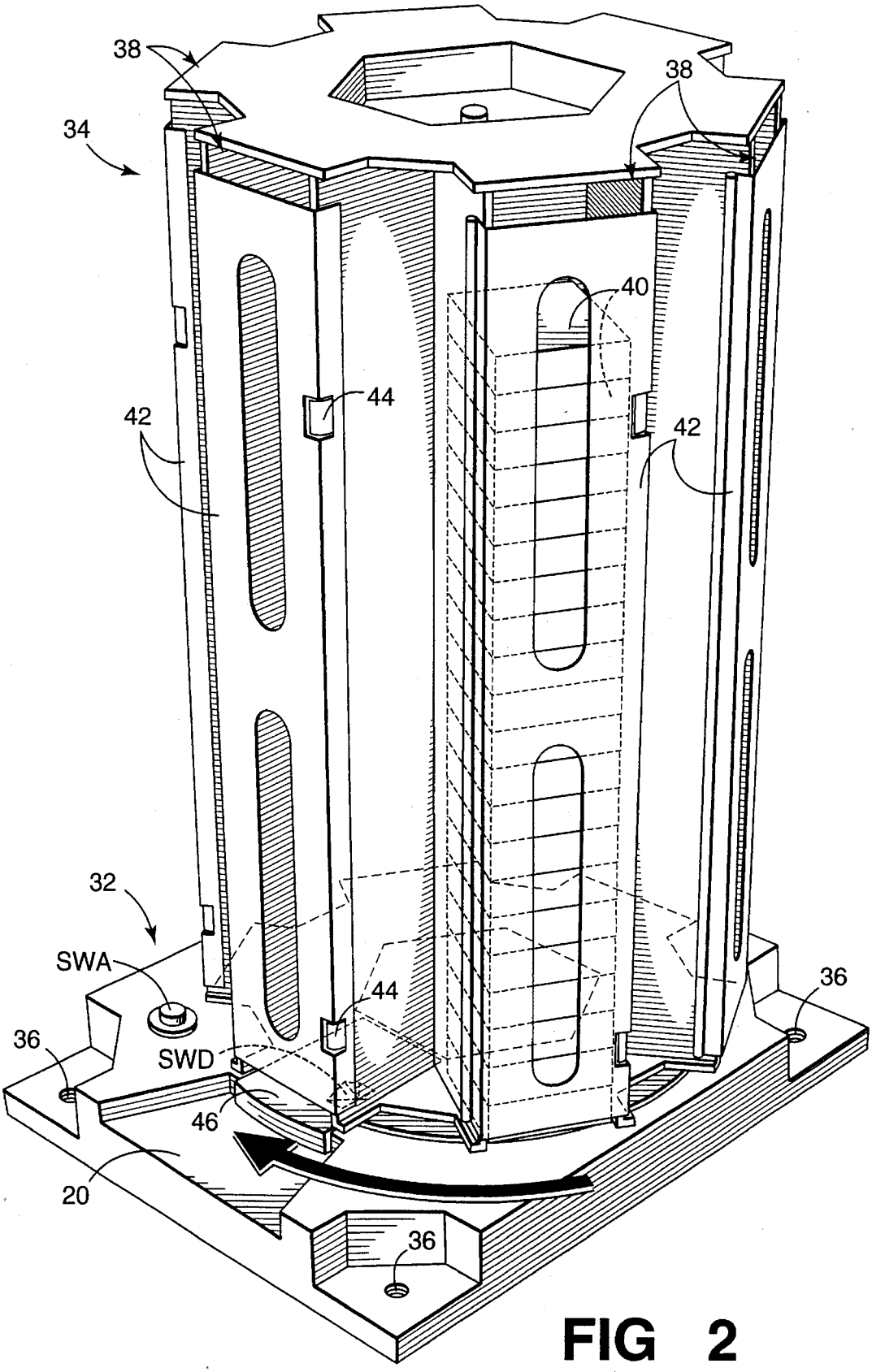
FIG. 2 illustrates a perspective view of the base portion and carousel of the vending machine according to the present invention.

FIG. 2 illustrates base 32 and carousel 34 in greater detail. Carousel 34 includes a cirumferential plurality of columns 38 which hold stacks of product packages 40, as seen in hidden lines. Carousel 34 may include any number of columns disposed along its periphery, depending upon the overall size of the machine with respect to the size of the packages to be dispensed. Column doors 42 provide access to each of the columns 38 during a replenishment period. Additionally, fasteners 44 releasably secure the column door into a closed position after a replenishment period. Additionally, each of the columns may accept a cartidge which is preloaded with packages. Finally, the carousel may rotatably mounted on a ball bearing to reduce friction in order to reduce energy consumption. Once loaded into a column, product packages of any size may be dispensed from the vending machine, including tetrahedron-, spherical-, or cylindrical-shaped objects.

A drive mechanism within base 32 rotates carousel 34 in a clockwise direction as shown by the arrow in FIG. 2, to align each column 38 over plunger 46. As explained in greater detail below, plunger 46 reciprocates within a recess of base 32 and dispenses each package 40, one at a time, from a column aligned over it. After the plunger has depleted all product packages in a single column, plunger surface switch SWD senses the lack of product in the column, and signals a microcontroller to rotate a circumferentially adjacent column over the plunger 46, as is explained in greater detail below. Additionally the forward resting position of the plunger prevents pilferage of the packaged products within the machine between dispensing cycles. This arrangement eliminates the need for separate antitheft components and allows more room for product packages within the small vending machine. Also, base 32 includes all mechanical dispensing and rotating components as well as all electronics, which also provides more room for product package storage.

Additionally, column advance switch SWA allows a technician to advance the carousel by 60 degrees (or other amount of rotation depending on the number of columns) to the next column each time the switch is depressed for access to the entire carousel, as is explained in greater detail below.

Figure 3A:
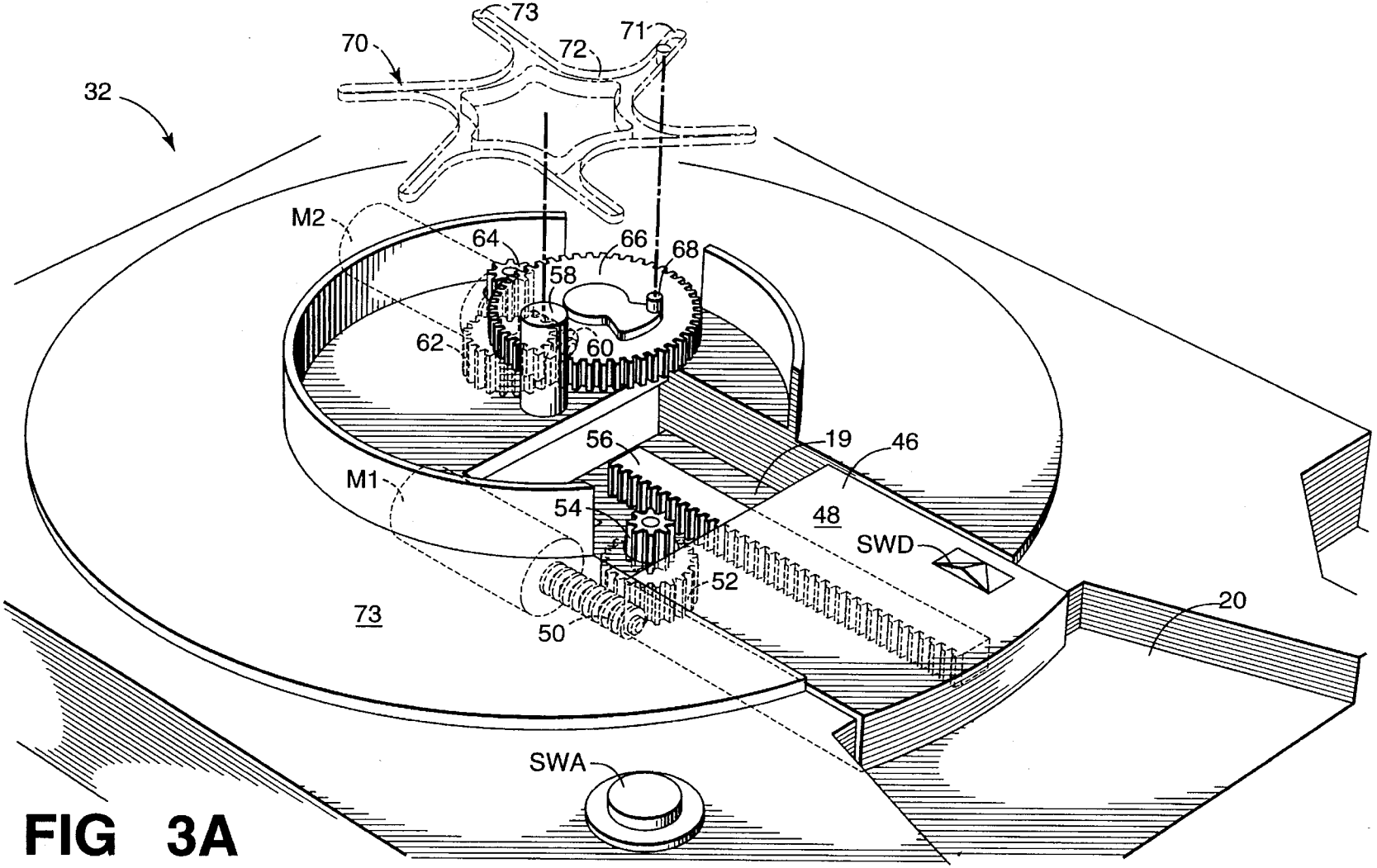
FIG. 3A illustrates a perspective view of the base portion of the vending machine, illustrating the carousel rotation means, the plunger assembly, and a cam portion of the carousel exploded vertically.
Figure 4:
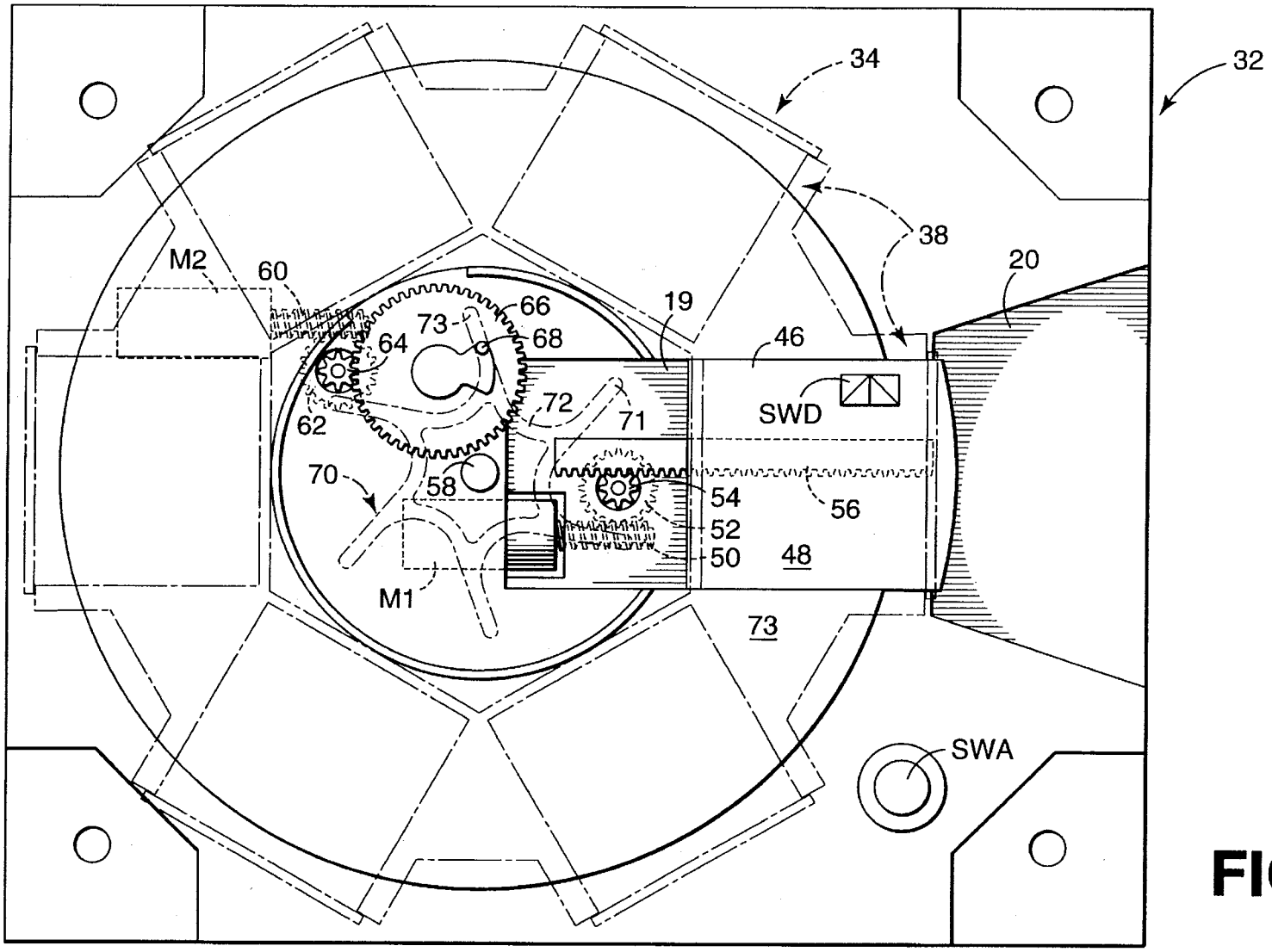
FIG. 4 illustrates a plan view of the carousel rotation means and the plunger assembly as orientated in the base portion with respect to the carousel columns.

FIG. 3A and 4 illustrate a preferred embodiment of the carousel drive mechanism in greater detail within the base 32 and within a bottom portion of the carousel, as shown by the dashed lines. Hidden lines illustrate carousel rotation motor M2 which rotates spiraled gear 60, which matingly engages pinion 62. Motor M2 may comprise any type of electric motor, however, the preferred embodiment of the present invention utilizes a six (6) volt direct current motor. Pinion 62 then drives coaxial pinion 64, which drives pinion 66. Furthermore, pinion 66 includes a cam driver 68 on a top surface there, which is positioned radially outward of a center portion of pinion 66. Finally, cam driver 68 engages a cam track 70 on a bottom portion of carousel 34, as is shown by the phantom lines in FIG. 3A.

As seen in FIGS. 3A and 4, cam 70 produces a 60 degree clockwise rotation of the carousel for every complete 360 degree clockwise rotation of pinion 66, from a perspective of looking downward onto carousel 34. Thus, during a complete rotation of pinion 66, cam driver 68 moves inward from a first apex 71 position with respect to the cam 70, while rotating cam 70 and carousel 34 in a clockwise direction. Approximately 180 degrees of rotation of pinion 66, moves cam driver 68 within 70 to U-shaped portion 72. In the final 180 degrees of rotation of pinion 66, cam driver 68 moves toward apex 73 with respect to the cam 70 while producing further clockwise motion of cam 70. Eventually, as pinion 66 approaches a full 360 degrees of rotation, cam driver 68 moves apex 73 to a circumferential position originally occupied by apex 71.

Thus, since cam 70 includes a total of six (6) radial extending apexes spaced equidistantly around a center portion of the carousel, a full rotation of pinion 66 produces a 60 degree rotation of the carousel, which is enough circumferential carousel displacement to align a new column with the plunger mechanism when a previous column has been depleted. Similarly, if the carousel contained only three (3) columns, then the cam would comprise three (3) apexes. Therefore, the number of equidistantly spaced cam apexes around the carousel center must equal the number of columns in the carousel to advance the carousel to a circumferentially adjacent column upon a full rotation of the pinion 66.

FIGS. 3A and 5A–5D also illustrate a plunger drive means for accomplishing the purposes of the present invention. Plunger 46 reciprocates within recess 19 of base 32 from a forward-most position, which is also its resting position, to a rearward-most portion, as illustrated by solid lines in FIG. 3B. Additionally, plunger top surface 48 is equal in height to top base surface 73. Since each column 38 within carousel 34 has an open bottom portion, each stack of product packages 40 rests upon top base surface 73 or plunger surface 48, depending on the circumferential position of a particular column.

Therefore, a column positioned above plunger 46 will allow its product package stack to rest upon plunger surface 48, while all other product package stacks within the remaining columns in carousel rest upon top base surface 72. As explained in greater detail below, the plunger mechanism depletes an entire stack of product packages positioned above the plunger before the carousel rotates another full column to the plunger area. Thus, flush relationship between surfaces 48 and 73 allows the carousel to smoothly transfer an entire stack of product packages from top base surface, onto plunger top surface 48.

Concerning the specific drive mechanism for plunger 46, motor M1 drives its spiraled pinion 50. Motor M1 may comprise any type of motor capable of driving a plunger having a full stack of product packages positioned thereon, but the preferred embodiment of the present invention utilizes a six (6) volt direct current motor. Spiraled pinion drives pinion 52, which drives pinion 54, which engages rack 56 on a bottom portion of plunger 46, thereby converting rotational motion from pinion 54 to translational motion on rack 56 and plunger 46.

Figure 3B:
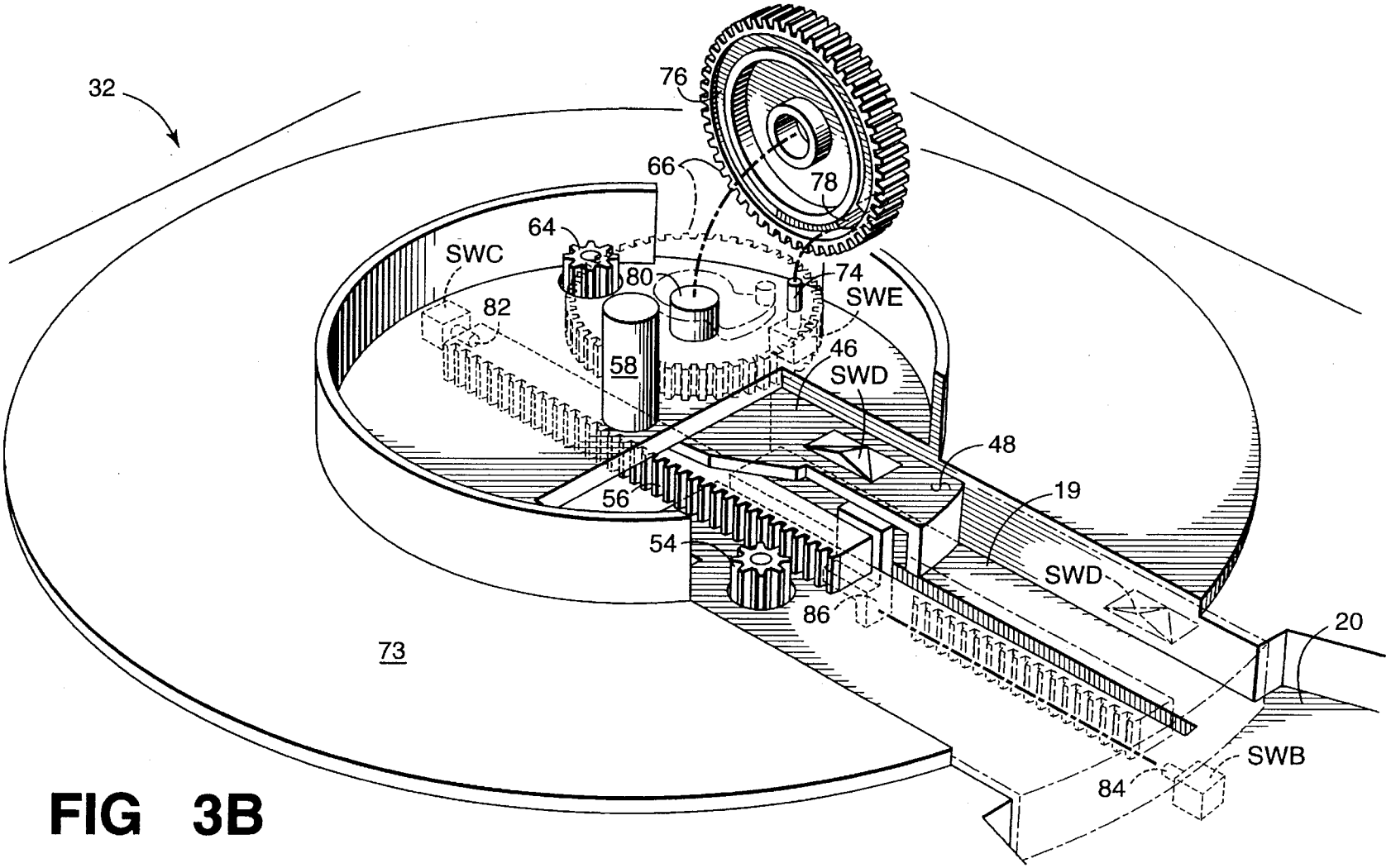
FIG. 3B illustrates a perspective view of the base portion of the vending machine illustrating control microswitches for carousel rotation means the plunger assembly in hidden lines.

FIG. 3B illustrates sensing mechanisms on the carousel and plunger mechanisms which, in combination with controller means, control movement of the plunger mechanism and carousel rotation mechanism. When motor M1 drives plunger 46 to its rearward-most position, rack 56 contacts and depresses stem 82 of switch SWC, which indicates to a microcontroller to reverse rotational direction of motor M1, as is discussed in greater detail below.

When motor M1 reverses its rotational direction and drives plunger 46 to its forward-most position, plunger tab 86 contacts and depresses stem 84 on switch SWB, which indicates to a microcontroller that the plunger has reached its forward-most portion, thereby prompting the microcontroller to deactivate motor M1, as is discussed in greater detail below. A forward and backward stroke of the plunger comprises a complete dispense cycle.

Figure 5A:
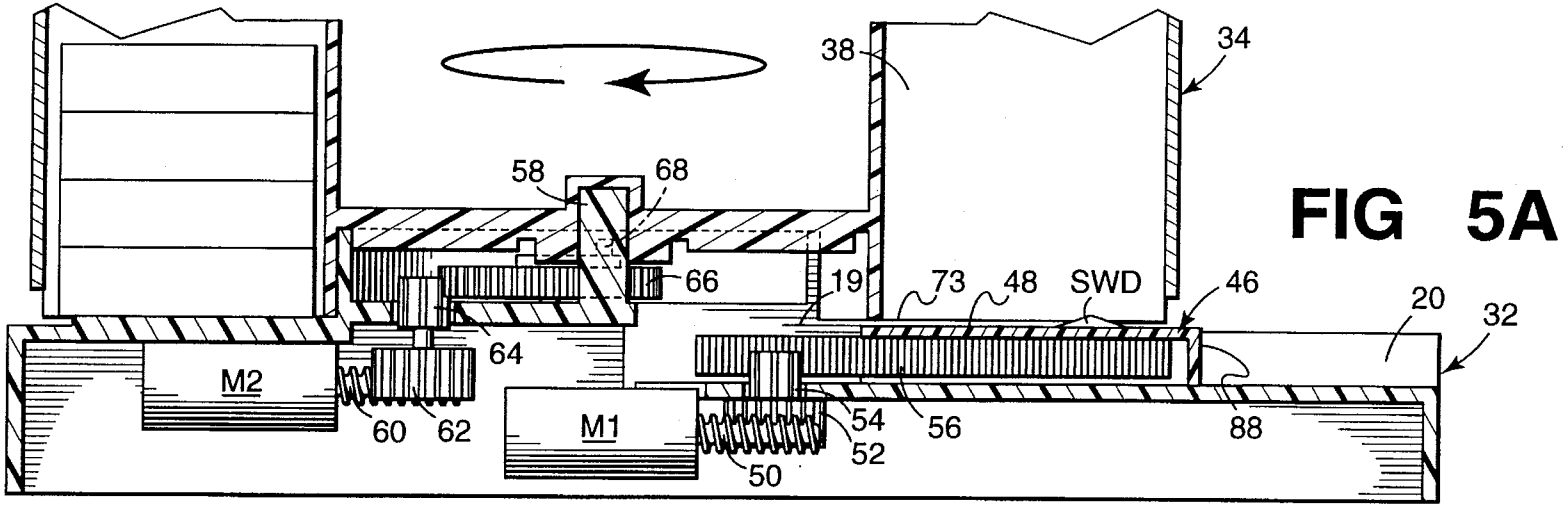
FIG. 5A illustrates a schematic representation of the gear set and motor which comprise the preferred carousel rotation means in the base portion of the present invention.
Figure 5B:
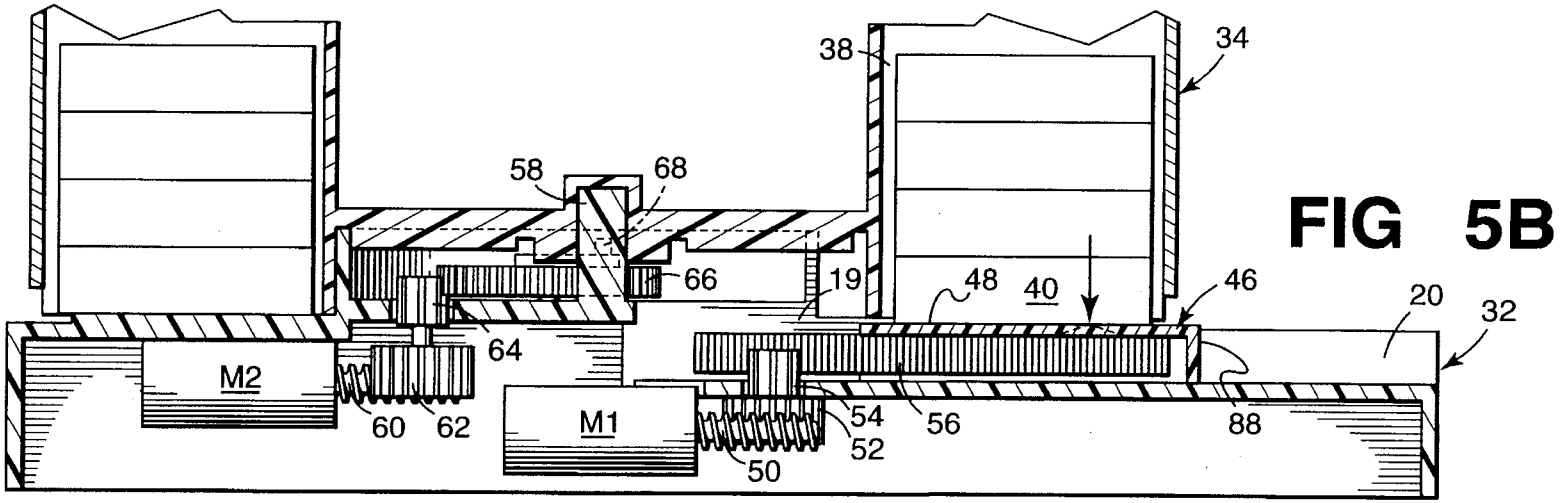
FIGS. 5B–5D illustrate a schematic representation of the plunger assembly reciprocation sequence when dispensing a product package from the inventive vending machine.
Figure 5C:
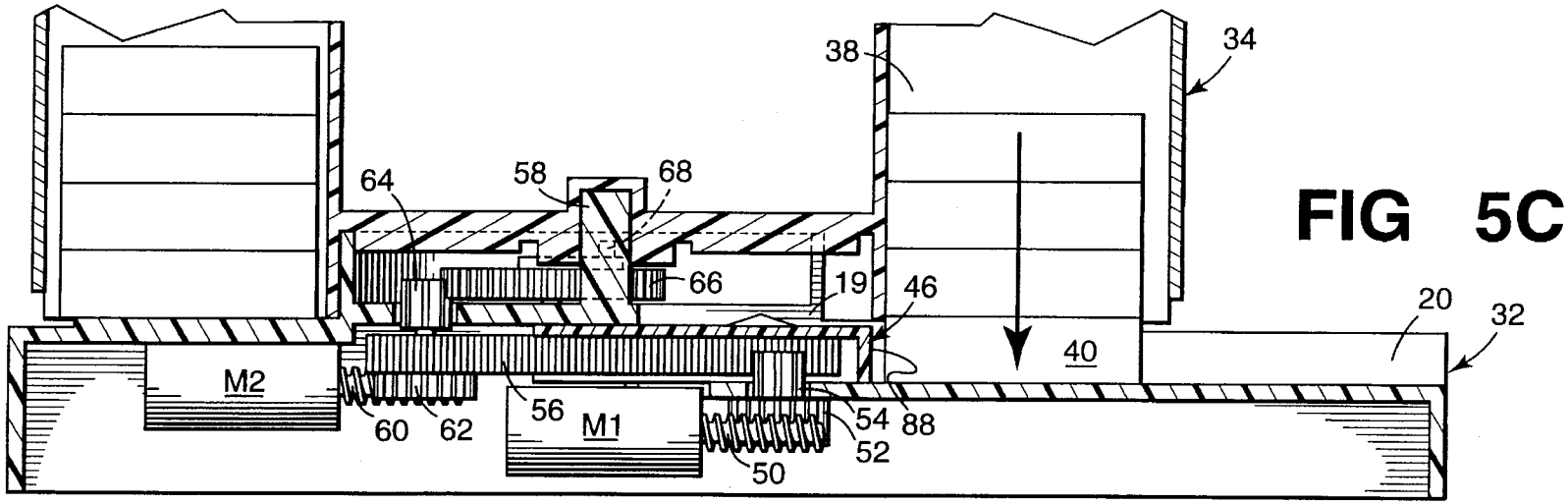
Figure 5D:
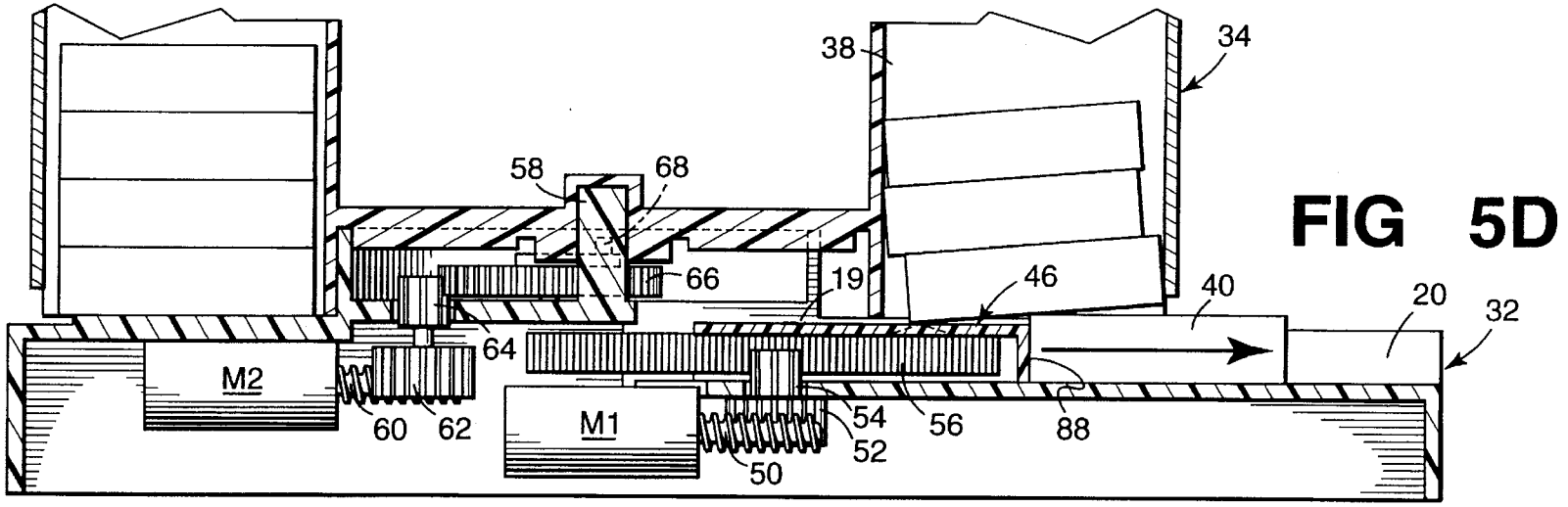

FIGS. 5B–5D illustrate displacement of a lower-most product package 40 onto a forward portion of recess surface 20 and into dispense area 18 during a dispense cycle. When a consumer inserts appropriate amount of change through merchandise coin slot 22, a microcontroller within the vending machine initiates a dispense cycle.

As discussed above, in a resting position, the lower-most product package in a stack rests on plunger surface 48, as shown in FIG. 5B. As plunger 46 retracts into its rearward-most position, the entire stack of product packages drops down into recess 19 as is illustrated in FIG. 5C. Finally, as the plunger moves toward its forward-most position, plunger edge 88 contacts a back edge of the lowermost product package and moves the package forward on recess surface 20 and out into dispensing area 18 for access by a consumer, as FIG. 5D illustrates.

FIG. 3B also illustrates a sensing mechanism for controlling carousel rotation. Base 32 supports switch SWE, which includes a stem 74 that rides in a cam track 76 on a lower surface of gear 66. Cam track 76 also includes a depression 78 which allows switch SWE to close when positioned above stem 74. Additionally, switch SWA opens when the vending machine dispenses the last product package in a stack due to the removal of weight from switch SWD. Furthermore, switch SWD includes a smooth, sloped surface which allows the carousel to easily rotate a new stack of product packages onto the plunger surface 48, thereby smoothly depressing switch SWA once again.

As is discussed in greater detail below, when switch SWD moves upward from a lack of product weight thereon, a microcontroller activates motor M2 to rotate gear 66 through the above-mentioned gear set, which rotates the carousel to position the next column over the plunger surface, hereinafter referred to as a carousel rotation sequence.

As discussed above, movement of a circumferentially adjacent column over the plunger surface requires a full rotation of gear 66. Therefore, before the initiation of a column rotation sequence, depression 78 is aligned with the motor switch SWE. After microcontroller initiates a column rotation sequence, switch SWE opens. After the opening of switch SWE, the microcontroller monitors the state of switch SWE. As soon as motor M1 rotates the gear a full 360 degrees, stem 74 reengages depression 78, closes switch SWE, which signals the microcontroller to deactivate motor M1, thus producing a full 360 degree rotation, which rotates a circumferentially adjacent column over plunger surface 48.

Electronic and Logic Control Layout

Figure 7A:
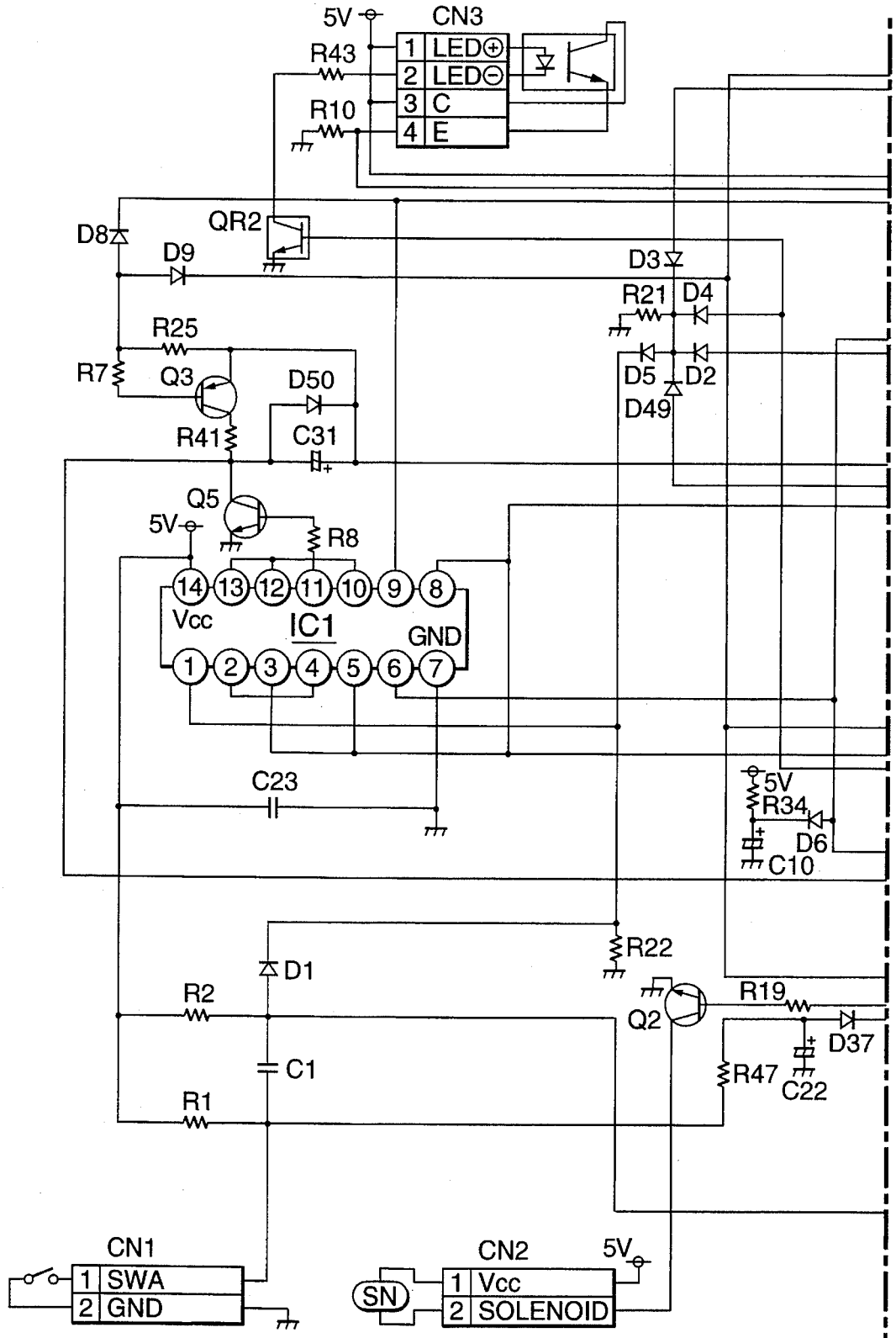
FIGS. 7A–7C illustrate a schematic circuit diagram of the electronic portions of the vending machine as illustrated in FIG. 1, showing specific examples of the microcontroller means, sensor means, electronic portions of the carousel rotation means, and electronic portions of the plunger assembly.
Figure 7B:
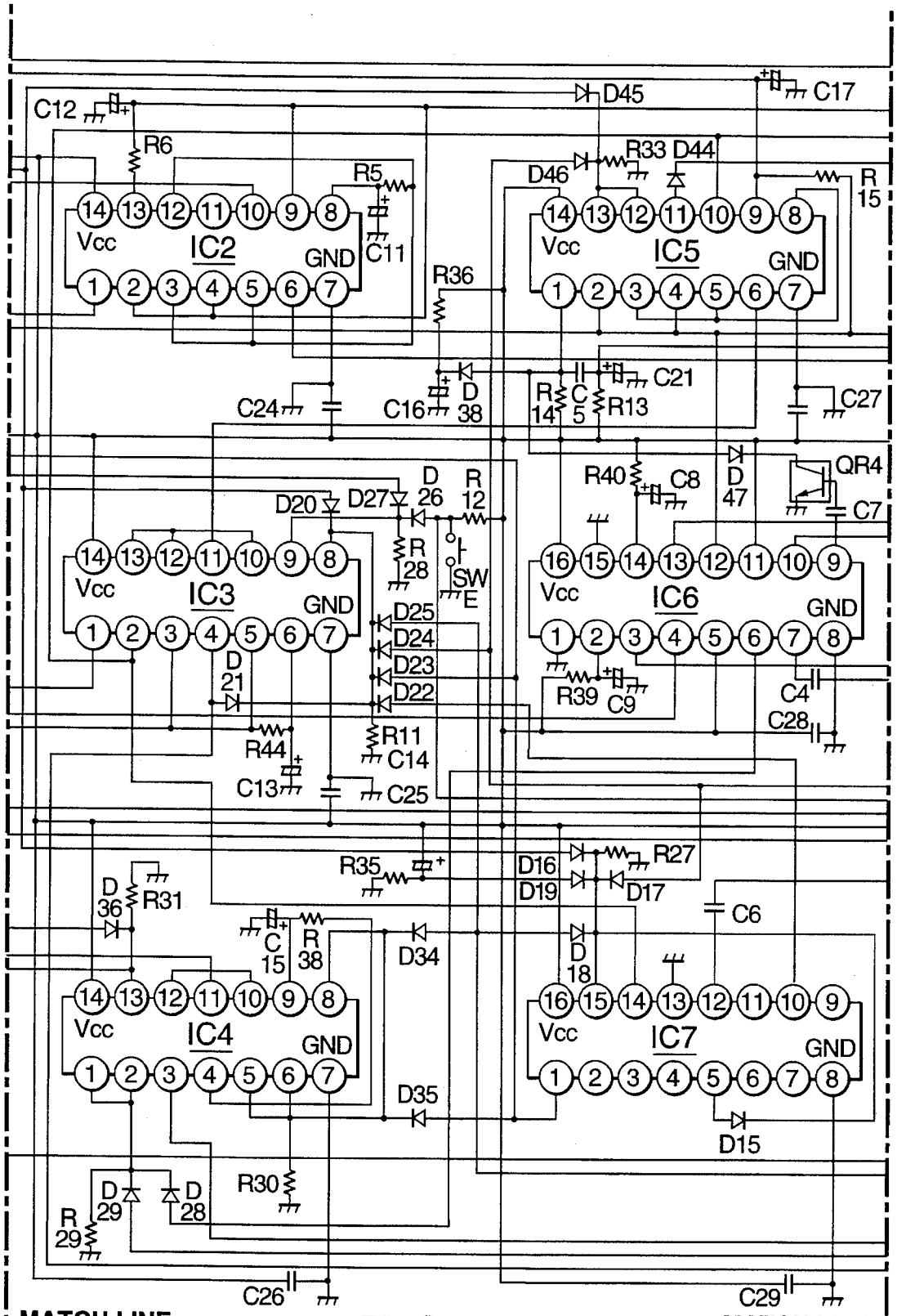
Figure 7C:
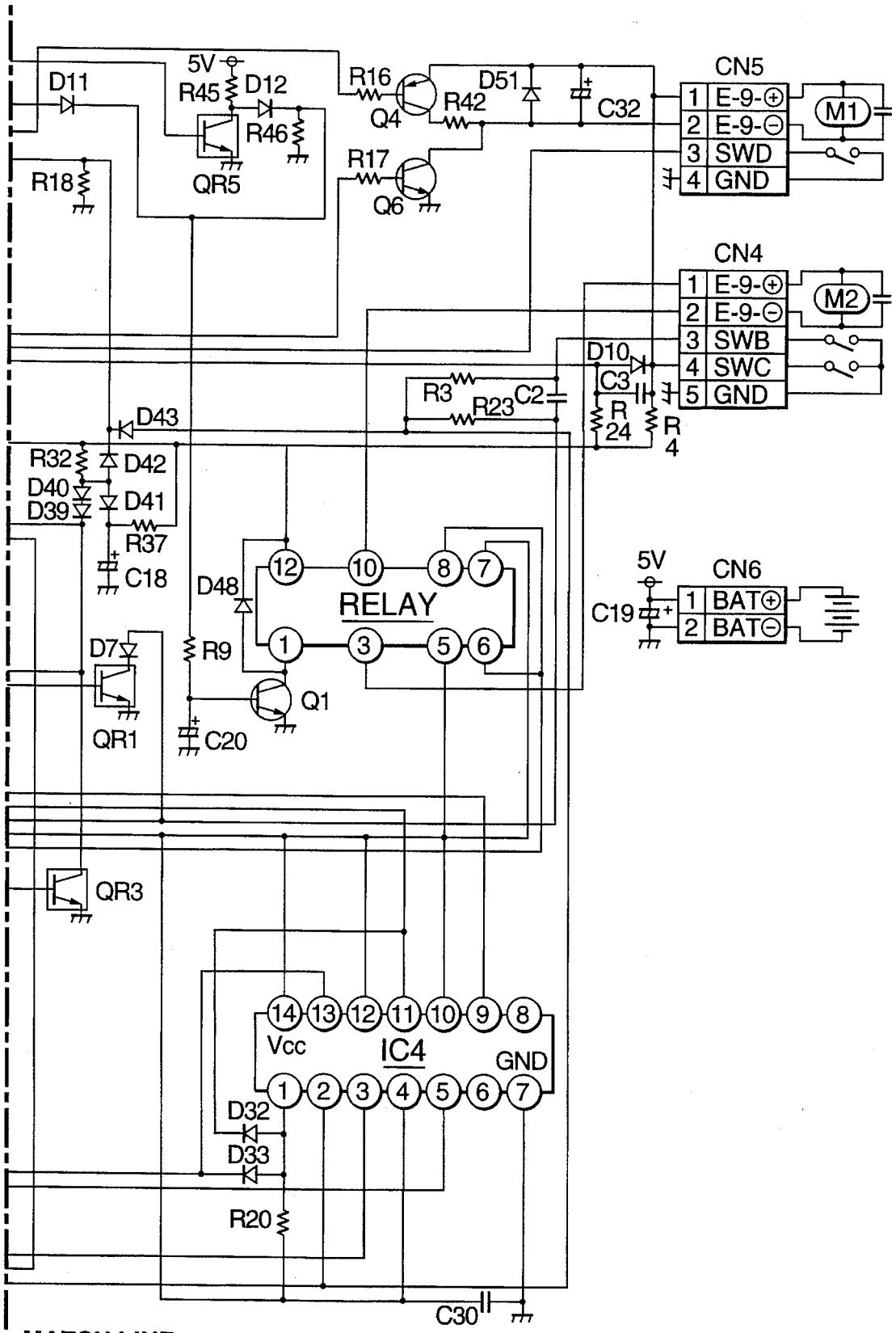

FIG. 6 illustrates a functional block diagram layout for the electronic portions of the inventive vending machine illustrated in FIGS. 7A–7C. Generally, a microcontroller of the present invention is comprised of a combination of integrated circuit chips IC1–IC8. This combination of integrated circuits interfaces with each of the switches SWA–SWE through connectors CN1–CN6 to implement the logic control of the vending machine. Details of the logic control are illustrated in greater detail in FIGS. 8–9.

Referring now to FIG. 6, the microcontroller interfaces with carousel advance switch SWA through connector CN1. Additionally, the microcontroller interfaces with the plunger control switches SWB and SWC through connector CN4 to implement plunger control. Furthermore, connector CN4 allows the microcontroller to activate and deactivate plunger motor M1 via relay RY and connector CN4 in response to signals received from switches SWB and SWC.

Similarly, connector CN5 allows the microcontroller to activate and deactivate carousel rotation motor M2 in response to signals received from switch SWD. Additionally connector CN2 allows the microcontroller to activate solenoid SN in order to: (1) change the currency sign to a "sold-out" sign; and (2) block merchandise coin slot 22. Finally, connector CN3 allows the coin switch SWCOIN to signal the microcontroller to begin a dispense cycle. The coin switch may be mechanical, or optical, as is illustrated in greater detail in FIGS. 7A–7C.

FIGS. 7A–7C illustrate a schematic circuit diagram of the electronic portions of the vending machine as illustrated in FIG. 1, showing specific examples of the microcontroller means, sensor means, electronic portions of the carousel rotation means, and electronic portions of the plunger assembly.

Referring now to FIGS. 7A–7C, connector CN3 interfaces coin switch SWCOIN into the control circuit. Specifically, terminal 1 of the diode controlled transistor microswitch is tied to a positive 5 volts, terminal 3 of connector CN3, pin 14 of integrated chip IC2, and pin 14 of integrated chip IC3. Additionally, terminals 1 and 3 of connector CN3 are tied to a forward terminal of diode D50 and a first terminal of C31. A rear terminal of diode 50 is tied to a second terminal of C31, the collector terminal of Q5, and pin 6 of the relay. Additionally, pin 11 of IC1 is tied through R8 to the base terminal of Q5. The emitter terminal of Q5 is tied ground.

Terminals 1 and 3 of CN3 are tied to: positive 5 volts, pin 14 of integrated circuit IC5; ground through resistor R36 and capacitor C16 in series; pin 16 of integrated circuit IC6; pin 14 of integrated circuit IC6 through resistor R40, pin 11 of integrated circuit IC6; ground through capacitor C27; to pins 3 and 13 of integrated circuit IC6 through resistor R32, D40, and D39 in series; ground through resistor R32, diode D41, and capacitor C18 in series; ground through resistor R37 and capacitor C18 in series; ground through resistor R37 and capacitor C18 in series; pin 12 of the relay; terminal 3 of connector CN4 through resistor R3; terminal 1 of connector CN5; terminal 4 of connector CN4 through resistor R4; and terminal 3 of connector CN4 through resistor R23 and capacitor C2 in series.

Terminal 4 of connector CN4 is tied to: ground through resistor R10; pin 8 of integrated circuit IC3 through diode D20; ground through diode D16 and resistor R27 in series; pin 13 of integrated circuit IC5 through diode D45; pin 12 of integrated circuit IC5 through diode D45; and ground through diode D45 and resistor R33.

Terminal 2 of connector CN3 is connected to the collector terminal of transistor QR2 through resistor R43. The emitter terminal of transistor QR2 is tied ground. Pin 6 of integrated circuit IC3 is tied ground through capacitor C13 and to pin 5 of the same integrated circuit through resistor R44. Pin 5 of integrated circuit IC3 is tied to pin 3 of the same integrated circuit. Furthermore, pin 3 of integrated circuit IC3 is tied to: ground through diode D4 and resistor R21 in series; and the base terminal of transistor QR2.

Column advance switch SWA is interfaced to the circuit in FIGS. 6A–6C through connector CN1. Terminal 1 of connector CN1 is tied ground and terminal 2 of connector CN1 is tied to: ground through capacitor C1, diode D1, and resistor R22 in series; and pin 1 of integrated circuit IC1.

Integrated circuit C1 is a fourteen pin chip which receives a rotate column sequence signal from switch SWA. Pin 1 of integrated circuit IC2 is tied to: pin 2 of integrated circuit IC5 through diodes D2 and D5 arranged in series; pin 4 of integrated circuit IC5 through diodes D2 and D5 arranged in series; pin 12 of integrated circuit IC6; pin 9 of integrated circuit IC5 through resistor R15; ground through resistor R15 and capacitor C17; and ground through resistor R15 diode D3, and resistor R21 in series. Pin 2 of integrated circuit IC1 is connected to pin 4 of the same integrated circuit. Pin 3 of integrated circuit IC1 is connected to: pins 3, 5 and 8 of the same integrated circuit; pin 4 of integrated circuit IC6; ground through diode D27 and resistor R28 arranged in series; and pin 9 of integrated circuit IC3 through diode D27. Pin 6 of integrated circuit IC1 is tied to: pin 1 of integrated circuit IC2; ground through diode D6 and capacitor C10 in series; to the collector terminal of transistor QR1 through diode D7; and terminal 3 of connector CN4 through capacitor C2.

Pin 7 of integrated circuit IC1 is tied to: ground; pin 14 of the same integrated circuit through capacitor C23; positive 5 volts through capacitor C23; pin 13 of integrated circuit IC7 through capacitor C23 and resistor R2 in series; ground through capacitor C23, resistor R1, resistor R47, and capacitor C22 in series; and pin 13 of integrated circuit IC4 through capacitor C23, resistor R1, resistor R47 and diode D37 in series. The connections for pin 8 of integrated circuit IC1 have been enumerated above. Pin 9 of integrated circuit IC1 is connected pin 10 of integrated circuit IC2. Additionally, the collector terminal of transistor Q3 is connected to the collector terminal of transistor Q5 through resistor R41. The base terminal of transistor Q3 is connected to pin 10 of integrated circuit IC2, resistor R7, and diode D8 in series. Furthermore, the base terminal of transistor Q3 is tied to its emitter terminal through resistors R7 and R25 in series. Finally, pins 10, 12 and 13 are tied together on integrated circuit IC1.

Referring now to integrated circuit IC2, pin 1 is tied to pin 6 of integrated circuit IC1 as enumerated above. Pin 2 of integrated circuit IC2 is tied to: pins 4 and 9 of the same integrated circuit; ground through capacitor C12; pin 13 of the same integrated circuit through R6; ground through diode D11 and resistor R46 in series; to positive 5 volts through diodes D11 and D12 and resistor R45 in series; ground through diode D11, resistor R9 and capacitor C20 in series; and to the base terminal of transistor Q1 through diode D11 and resistor R9 in series.

Pin 3 of integrated circuit IC2 is tied to: ground through resistor R5 and capacitor C5 in series; pin 8 of the same integrated circuit; and pin 5 of the same integrated circuit. Pin 6 of integrated circuit IC2 is tied terminal 4 of connector CN4 diode D10 and capacitor C3 in parallel; and terminal 1 of connector CN5 through resistor R24. Pin 7 of integrated circuit IC2 is tied ground. Pin 11 of integrated circuit IC2 is tied to: the base terminal QR5; pin 1 of integrated circuit IC3; to a positive 5 volts; ground through diode 36 and resistor R31; and pin 13 of integrated circuit IC4 through diode D36. Pin 12 of integrated circuit IC2 is tied pins 3 and 5 of the same integrated circuit; and pin 8 of the same integrated circuit through resistor R5.

Referring in integrated circuit IC3, pin 2 is connected to: pin 14 of integrated circuit IC7; pin 10 of integrated circuit IC5; and to the base terminal of transistor Q4 through resistor R16. The emitter terminal of transistor Q4 is tied terminal 1 of connector CN5. The collector terminal of transistor Q4 is tied terminal 2 of connector CN5 and the collector terminal of transistor Q6 through R42. Additionally, diode D51 and capacitor C32 are connected in parallel between the emitter terminal of transistor Q4 and terminal 2 of connector CN5.

Pin 4 of integrated circuit IC3 is tied to: ground through diode D21 and resistor R11; pin 2 of integrated circuit IC2; ground through diode 43 and resistor R18 in series; pin 11 of integrated circuit IC5 through diodes D43 and D44 in series; ground through diodes D43, D42 and D41 and capacitor C18 in series; and pin 8 of the same integrated circuit.

Pin 7 of integrated circuit IC3 is connected to: ground; pin 4 of integrated circuit IC4 through capacitor C25; ground through capacitors C25 and C14 and resistor R35 in series; pin 14 of integrated circuit IC3 through capacitor C25; pin 2 of integrated circuit IC6 through capacitor C25 and R39 in series; ground through capacitor C25, resistor R39, and capacitor C9 in series; pin 5 of integrated circuit IC6 through capacitor C25; ground through capacitors C25 and C28 in series; pin 16 of integrated circuit IC7 through capacitor C25; ground through capacitors C25 and C29 in series; pin 1 of integrated circuit IC8 through capacitor C1 and resistor R20 in series; pin 4 of integrated circuit IC8 through capacitor C25; ground through capacitors C25 and C30; pins 14, 12 and 10 of integrated circuit IC8 through capacitor C25; and pins 5 and 7 of the relay RY. Pin 9 of integrated circuit IC3 is tied ground through resistor R28. Pins 10, 12 and 13 are tied together in integrated circuit IC3. Pin 11 of integrated circuit IC3 is tied pin 6 of integrated circuit IC5.

Referring to integrated circuit IC4, pin 2 is tied to: pin 1 of the same integrated circuit; and ground through R29. Pin 3 of integrated circuit IC4 is tied pin 3 of integrated circuit IC8. Pin 4 of integrated circuit IC4 is tied to: pin 9 of the same integrated circuit through R38; and ground through capacitor C15. Pin 5 of integrated circuit IC4 is tied to: pins 6 and 8 of the same integrated circuit; and ground through resistor R30. Pins 10 and 12 of integrated circuit IC4 are tied together. Pin 11 of integrated circuit IC4 is tied to the base terminal of transistor Q2 through R19. The emitter terminal of transistor Q2 is grounded and its collector terminal is tied terminal 1 of connector CN2. Terminal 1 of connector CN2 is tied to positive 5 V.

Referring to integrated circuit IC5, pin 1 is tied to: pin 16 of integrated circuit IC6; ground through capacitors C5 and C21 in series; pin 14 of integrated circuit IC6 through capacitor C5 and resistors R13 and R40 in series. Pins 3, 5 and 8 are also tied together in integrated circuit IC5. Also, pin 9 is tied to the collector terminal of transistor QR4 through diodes D3, D49 and D47 in series.

Referring to integrated circuit IC6, pins 1, 8 and 15 are connected ground. Pin 6 is tied pin 2 of integrated circuit IC4 through diode D28. Pin 7 is tied to the base terminal of transistor QR1 through capacitor C4, and the emitter terminal of transistor QR1 is tied ground. Pin 9 is connected to the base terminal of transistor QR4 through capacitor C7. Transistor QR4 has its emitter terminal tied ground. Additionally, transistor QR5 has its emitter terminal tied ground. Pin 10 of integrated circuit IC6 is tied ground through diode D29 and resistor R29 in series. Finally, pin 14 of integrated circuit IC6 is tied ground through capacitor C8.

Referring to integrated circuit IC7, pin 1 is tied to pins 5 an 6 of integrated circuit IC4 through diode D35. Pins 2, 3, 4, 6, 7, 9 and 11 are unused. Pins 13 and 8 are tied ground. Pin 5 is tied pin 15 through diode D15. Pin 10 is tied to: ground through diode D22 and resistor R11 in series; pin 8 of integrated circuit IC3 through diode D22; and pin 4 of integrated circuit IC3 through diodes D22 and D21 in series. Pin 12 is connected to the base terminal transistor QR3 through capacitor C6. Transistor QR3 has its emitter terminal grounded and its collector terminal tied pins 3 and 13 of integrated circuit IC6. Also, pin 1 of integrated circuit IC7 is tied ground through diode D23 and R11 in series.

Referring to integrated circuit IC8, pin 1 is connected pin 11 of the same chip through diode D22. Pin 5 is connected to: pin 8 of integrated circuit IC4 through diode D34; pin 15 of integrated circuit IC7 through diode 18; and ground through diode D25 and resistor R11 in series. Pins 6 and 8 in integrated circuit IC6 are unused while pin 7 is grounded. Pin 9 is tied to: pin 15 of integrated circuit IC7 through diode D17; ground through diode D17, diode D16, and resistor R35 in series; pin 8 of integrated chip IC3 through diode D24; pin 13 of integrated circuit IC5 through diode D46; ground through diodes D46 and resistor R33 in series; and ground through diode D24 and resistor R11 in series.

Referring to the relay, pin 1 is tied to: pin 12 through diode D48; and the collector terminal of transistor Q1, while its emitter terminal is tied ground; and pin 3 is tied terminal 1 of connector CN1. Pin 10 is tied to terminal 2 of connector CN4.

The base terminal of transistor Q5 is tied to: pin 9 of IC5 through resistor R17 and resistor R15 in series; pins 2 and 4 of integrated circuit IC5 through resistor R17; and pin 1 of integrated circuit IC1 through resistor R17, and diodes D2 and D5. The emitter terminal of transistor Q5 is tied ground. Terminal 3 of connector CN5 is tied ground through capacitor C21, and terminal 4 of connector CN5 is tied ground. Additionally, terminal 5 of connector CN5 is tied ground. Connector CN6 has a capacitor C19 between its positive and negative terminals. Terminal 2 of connector CN2 is also tied ground and a negative terminal of a 5 volt battery while terminal 1 is tied to positive 5 volts.

Referring to each of the connectors, connector CN2 interfaces terminals of solenoid SN which actuates: (1) the "sold-out"/currency sign in space 22; and (2) the coin slot blocker, as seen in FIG. 6. Connector CN1 interfaces column advance switch SWA terminals 1 and 2. As discussed above, connector CN3 interfaces a coin switch terminals 1–4. Referring to connector CN4, terminals 1 and 2 are connected in parallel to motor M1 and capacitor MC1. Terminals 3 and 4 interface a single terminal each for switches SWB and SWC, while the other terminals of SWB and SWB are tied commonly to terminal 5.

Connector CN5 has terminals 1 and 2 tied in parallel to motor M2 and capacitor M2C, has terminal 3 tied to one terminal of switch SWD, and has terminal 5 tied to the other terminal of switch SWD. Finally, switch SWE is tied at one terminal ground and at its other terminal to: ground through diode D26 and resistor R28 in series; pin 9 of integrated circuit IC3 through diode D26; ground through resistors R39 and R12 and capacitor C9 in series; pin 5 of integrated circuit IC6; ground through resistor R12 and capacitor C28 in series; pin 16 of integrated circuit IC7 through resistor R12, pin 1 of integrated circuit IC8 through resistors R12 and R20; pins 4, 10 and 12 of integrated circuit IC8 through resistor R12; and ground through resistor R12 and capacitor C30 in series.

The table below illustrates a complete part list for the above referenced circuit, including, where possible, part numbers, component values, and part manufacturers.

PARTS SPECIFICATION TABLE

| COMPONENT REFERENCE NUMERAL | COMPONENT DESCRIPTION/ VALUE | PART NUMBER/ MANUFACTURER |
|---|---|---|
| IC1–5 | Integrated Circuit Chip | BU4093B/Rome |
| IC6 | Integrated Circuit Chip | BU4538B/Rome |
| IC7 | Integrated Circuit Chip | 74HC4017/Toshiba |
| IC8 | Integrated Circuit Chip | 74HC74/Toshiba |
| R41 | Resistor/1 Ohm, 1/5 w | Rome |
| R42 | Resistor/5.1 Ohm, 1/5 w | Rome |
| R43 | Resistor/270 Ohm, 1/5 w | Rome |
| R7, 8, 16, 17 | Resistor/2.2 kOhm, 1/5 w | Rome |
| R44 | Resistor/33 kOhm, 1/5 w | Rome |
| R1–6, 9–15, 18, 19, 46 | Resistor/56 kOhm, 1/5 w | Rome |
| R34–38 | Resistor/100 kOhm, 1/5 w | Rome |
| R47 | Resistor/330 kOhm, 1/5 w | Rome |
| R20–25, 27–33, 45 | Resistor/560 kOhm, 1/5 w | Rome |
| R39,40 | Resistor/1 MOhm, 1/5 w | Rome |
| D1–12, 15–49 | Diode | 1SS254/Rome |
| D50, 51 | Diode | 1SR139-100/Rome |
| C1–7, 23–30 | Ceramic Condenser Capacitor 0.1 μF | Rome |
| C8, 20 | Electrolysis Condenser Capacitor 10 μF, 16 v | Nichicon |
| C9 | Electrolysis Condenser Capacitor 10 μF, 16 v | Nichicon |
| C10–18, 21, 22 | Electrolysis Condenser Capacitor 10 μF, 16 v | Nichicon |
| C19 | Electrolysis Condenser Capacitor 10 μF, 16 v | Nichicon |
| C31,32 | Electrolysis Condenser Capacitor 1 μF, 50 v | Nichicon |
| M1C | Capacitor 1 μF | |
| M2C | Capacitor 1 μF | |
| QR1–5 | Digital Transistor | DTC144ES/Rome |
| Q1, 2 | Transistor | 2SC1645/Rome |
| Q3, 4 | Transistor | 2SB1184/Rome |
| Q5,6 | Transistor | 2SD1760/Rome |
| RY | Relay | G5A-237P/Omuron |
| SWA | Column Advance Switch | Omuron |
| SWB | Front Plunger Switch | Omuron |
| SWC | Rear Plunger Switch | Omuron |
| SWD | Plunger Surface Switch | Omuron |

-continued

PARTS SPECIFICATION TABLE

| COMPONENT REFERENCE NUMERAL | COMPONENT DESCRIPTION/ VALUE | PART NUMBER/ MANUFACTURER |
|---|---|---|
| SWE | Cam Follower Switch | Omuron |
| SWCOIN | Coin Microswitch | Omuron |
| CN1, 2, 6 | Connector (2 pole) | IL-G-2P-S3T2-E/Japan Airlines Electric |
| CN3, 5 | Connector (4 pole) | IL-G-4P-S3T2-E/Japan Airlines Electric |
| CN4 | Connector (5 pole) | IL-G-5P-S3T2-E/Japan Airlines Electric |
| SN | Solenoid | |
| M1 | Plunger Drive Motor/6 vDC | |
| M2 | Carousel Rotation Motor/ 6 vDC | |

Figure 8A:
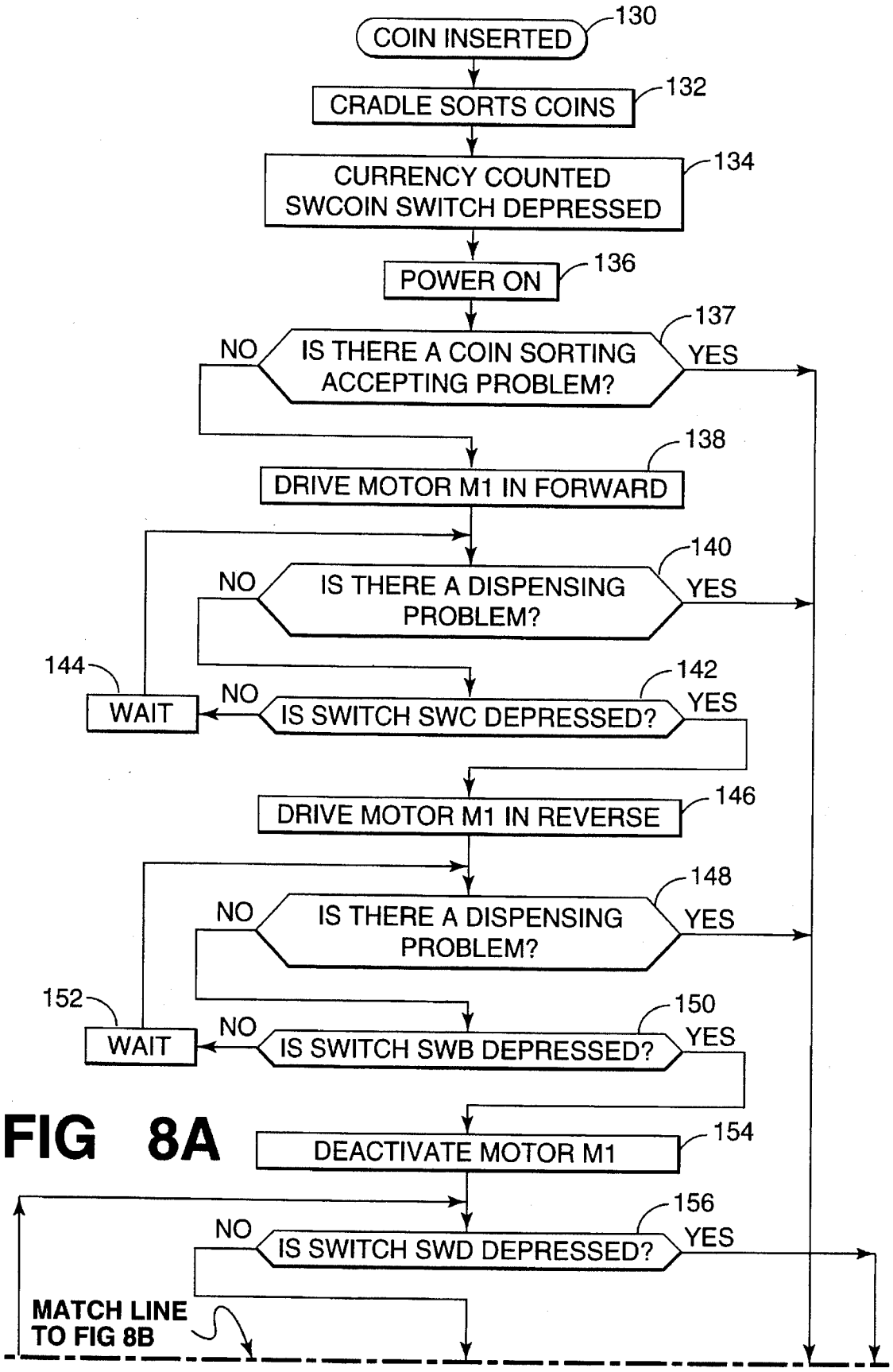
FIGS. 8A and 8B illustrate an operational flow chart showing the operation of the microcontroller means illustrated in FIGS. 6, 7A–7C of the vending machine according to the present invention.
Figure 8B:
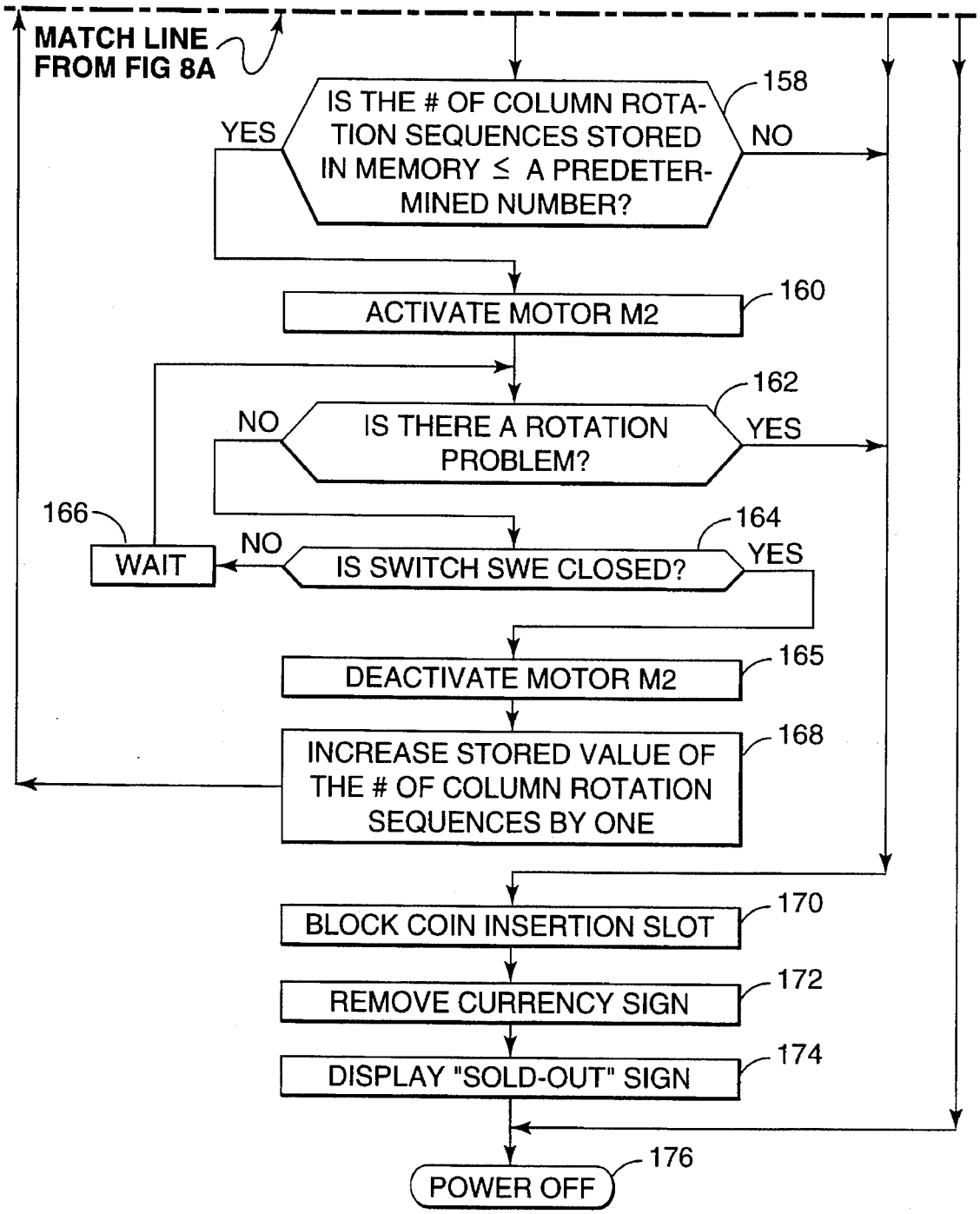

FIGS. 8A and B illustrate an operational flow chart of the microcontroller means illustrated in FIGS. 6 and 7A–7C of vending machine 2. Start box 130 indicates a user inserting the appropriate amount of change through coin slot 22 of the vending machine. Upon currency insertion, a cradle within currency mechanisms 26 and 28 may sort the coins, and determine if the consumer has inserted the correct amount of currency, as is illustrated in action box 132.

Once the cradle receives the correct amount of currency by the consumer, the cradle depresses a coin switch SWCOIN, as illustrated in action box 134. Switch SWCOIN turns the vending machine power on, as indicated in action box 136. Immediately, the microcontroller monitors the coin switch to determine if there is a currency sorting or accepting problem, as indicated in question box 137. Generally, currency problems result in switch SWCOIN remaining closed. Therefore, if the microcontroller determines that SWCOIN remains closed for a predetermined period of time, it decides that there is a problem and shuts down the vending machine.

Thus, upon discovery of a coin sorting or accepting problem, the microcontroller actuates solenoid SN to block the coin insertion slot 22. Solenoid SN also removes the currency sign displayed in space 22 and replaces it with a "sold-out" sign, as is indicated in action boxes 170, 172, and 174. After displaying the "sold-out" sign, the vending microcontroller then turns the vending machine off to conserve battery power, as indicated in end box 176.

If no coin sorting or accepting problem exists, the microcontroller activates plunger motor M1 to begin a product dispense cycle, as indicated in command box 138. Immediately upon activation of plunger motor M1, the microcontroller inquires as to whether there is a dispensing problem, as indicated in question box 140. Generally, a dispensing problem results in the plunger 46 becoming jammed, which produces a power surge that the microcontroller may sense. If the microcontroller senses such a problem it initiates the vending machine shut-down sequence illustrated in boxes 170, 172, 174, and 176, in order to conserve power.

Additionally, the microcontroller inquires as to whether switch SWC has been depressed by the plunger rack 56, as indicated in question box 142. The microcontroller continues in this loop including a predetermined wait period, as set forth in command box 144, until rack 56 depresses switch SWC. When rack 56 depresses switch SWC, the microcontroller reverses the rotation of motor M1, which of course causes the rack 56 and plunger to move in the opposite direction as is illustrated in FIG. 5D to displace the lowermost product package 40 into the dispensing area 18 for access by a consumer.

As the plunger motor M1 continues in its reverse direction to dispense an article, the microcontroller again monitors for dispensing problems by sensing for motor M1 power surges and also monitors switch SWB to see if it has been depressed by plunger tab 86, which indicates that the plunger is in its forward-most position, as indicated in FIG. 3B. If the microcontroller senses a power surge or unusual power consumption by motor M1, which indicates that the plunger is jammed, the microcontroller will proceed with the shut-down sequence as described above and illustrated in command boxes 170, 172, 174, and 176.

If the microcontroller has still not sensed a dispensing problem, and plunger tab 86 depresses switch SWB, then the microcontroller deactivates motor M1 and determines as to whether switch SWD on plunger surface 48 is depressed, as indicated in command box 154 and question box 156. If at least one product still remains on plunger surface 48, switch SWD will remain depressed which indicates to the microcontroller that another product is ready to be dispensed. If product remains on switch SWD, then the microcontroller turns the vending machine off until another consumer inserts currency into currency slot 22, as indicated by command box 176.

If switch SWD is not depressed, product packages do not remain on the plunger surface 48. If this occurs, then the microcontroller checks its memory to see if it has performed any column rotation sequences since the last time it has been refilled, and determines if that number is less than or equal to a predetermined value, as seen in question box 158.

Normally the predetermined value is one less the number of columns in the carousel. For instance, in a six column carousel, a minimum of five (5) carousel rotation sequences must be performed to rotate each column over the plunger to completely empty the carousel. Thus, in the preferred embodiment, if the number of column rotation is less than or equal to five (5), then the microcontroller begins a column rotation sequence, if not, the microcontroller performs the shut down sequence set forth in boxes 170, 172, 174, and 176.

During a column rotation sequence, the microcontroller activates carousel rotation motor M1, as seen in command box 160. In a manner similar to the procedure in command boxes 140 and 148, the microcontroller senses for a power surge or an unusual power drain to determine if the carousel has become jammed or if the motor components have malfunctioned, as illustrated in question box 162. If so, the microcontroller performs the shut-down sequence set forth in boxes 170, 172, 174, and 176.

If the microcontroller does not sense a rotation problem, it checks switch SWE to see if it is closed, as seen in question box 164. If not, the microcontroller monitors switch SWE closed until it closes, which indicates that stem 74 has extended into depression 78 of cam 76 on gear 66, and that gear 66 has rotated a full 360 degrees, thereby completing a column rotation sequence by moving the next column over plunger surface 48. When stem 74 extends to close switch SWE, the microcontroller deactivates motor M2, as seen in command box 165.

After the microcontroller deactivates motor M2, it increases the stored value of the number of column rotation sequences by one and checks to see if switch SWD is depressed, as seen in question box 156. If product is in the next column, switch SWD will be depressed, the vending machine will be ready to dispense again, and the machine powers down, as seen in end box 176. If switch SWD is not depressed, the column rotation sequence is repeated until all columns have been checked.

Figure 9:
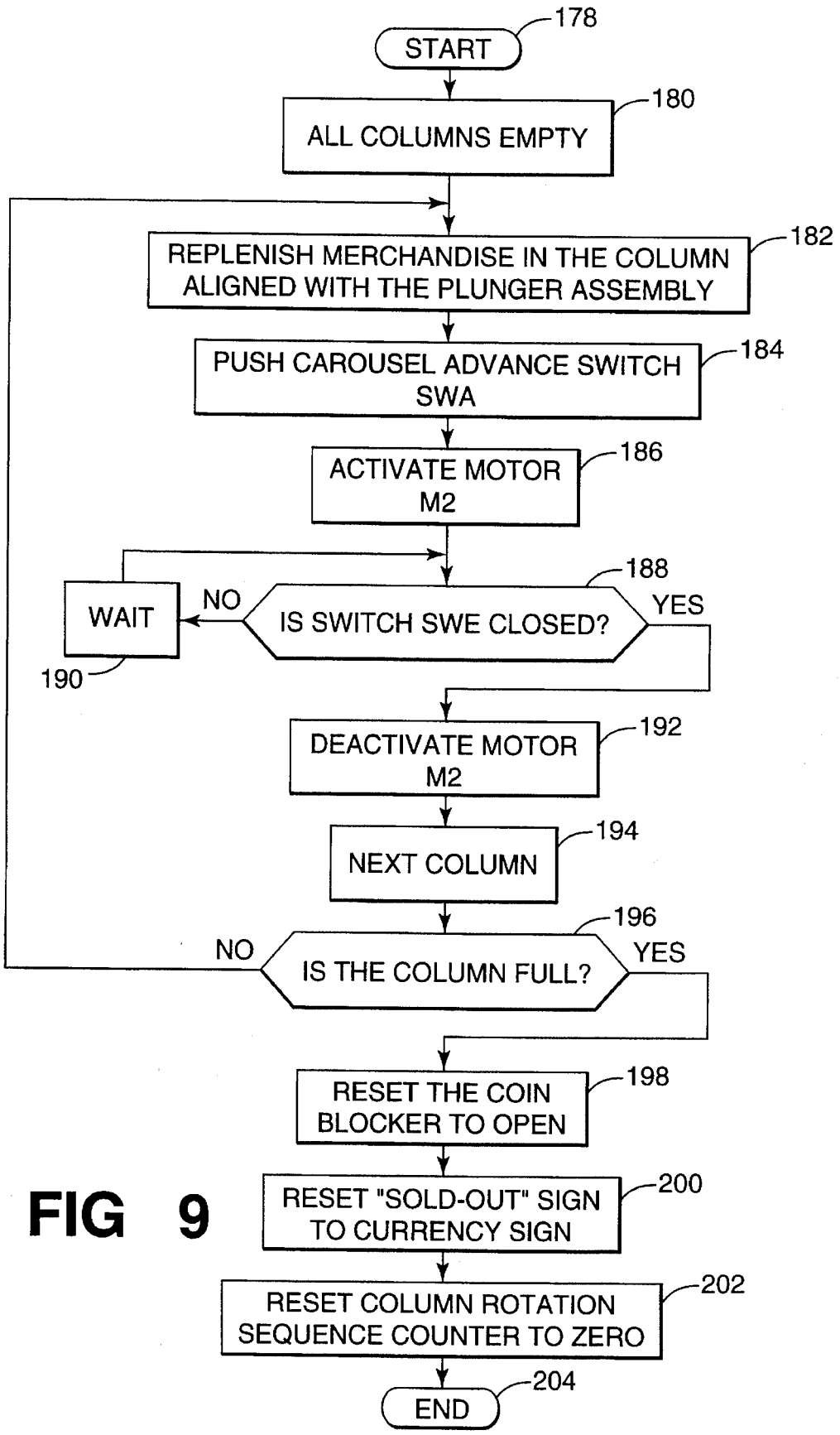
FIG. 9 illustrates a replenishment flow chart for the vending machine according to the present invention.

FIG. 9 illustrates a replenishment flow chart for the vending machine according to the present invention. Generally, a technician may implement the routine illustrated in FIG. 9 when the vending machine has emptied itself or has shut down from a malfunction. A start point 178 of the routine includes unlocking lock 16, opening the front panel 6, recovering change from the merchandise and donation change bins, and clearing any debris that may be blocking rotation of the carousel or reciprocation of the plunger.

As indicated in box 180, all of the columns are empty during a refill period unless a malfunction has occurred. The technician opens column door 38 and refills the column over the plunger surface 48, as indicated in box 182. If the technician pushes the carousel advance switch SWA, the microcontroller initiates a carousel rotation sequence, as seen in boxes 184 and 186. As described above, the microcontroller then waits until the switch SWE has closed, indicating that a new column has been advanced, and deactivates the motor M2, as indicated in boxes 188, 190, 192, and 194.

If all columns have been filled, the technician resets the coin blocker to an open position, resets the sold-out sign to the currency sign, and resets the column rotation sequence counter to zero, as indicated by boxes 198, 200, 202. A sequence counter may automatically be reset when the technician presses carousel advance switch, or by other means. If all columns have not been filled then the technician repeats the process until each column in the carousel is full, as indicated by box 198.

Also, the coin-blocker and "sold-out"/currency sign may be mechanically linked to solenoid SN such that a single motion from the technician to reset them all may be sufficient. This is also a good time to replace the batteries. Thus, when all columns are filled and the front panel is closed, the refill sequence is complete, as indicated in box 204.

It should be understood that various changes to the present invention may be made by the ordinarily skilled artisan, without departing from the spirit and scope of the present invention which is presented in the claims below. For example, the ordinarily skilled artisan will recognize that the cam/cam driver arrangement is but one configuration of many which may be used to rotate the carousel. Any appropriate actuation means may be used to rotate the carousel in accordance with the invention.

Furthermore, any actuation means may be used to reciprocate the plunger. For example, the plunger actuation means may include and also may not be limited to a solenoid. Moreover, any type of coin switch may be used to activate the vending machine. The switch may comprise a microswitch, optical means, or any other means which may recognize the correct amount of currency to signal the vending machine to dispense a product.

The ordinarily skilled artisan will understand that this disclosure presents an example of the invention and is not meant to limit the invention, as presented in the claims, in any way whatsoever.

What is claimed is:

1. A vending machine for dispensing a product comprising:

a frame;

a carousel rotatably fastened to said frame including a plurality of column compartments arranged along a circumference of said carousel, wherein each said column is adapted to store a stack of products;

a reciprocating plunger assembly adapted to horizontally displace a bottom-most product of a stack within a column which is aligned with said plunger assembly;

control means for controlling said plunger assembly; and a donation slot and secure receptacle for accepting donations, wherein said donation slot is separate from a currency slot for accepting currency in exchange for merchandise.

2. The vending machine of claim 1 further comprising:

a currency slot adapted to accept currency for a product;

a currency sensor adapted to send a dispense signal to said control means when a predetermined amount of currency has been detected.

3. The vending machine of claim 2 wherein said control means is responsive to said dispense signal for activating said plunger assembly.

4. The vending machine of claim 3 further comprising a sensor for detecting product depletion in a column aligned with said plunger assembly.

5. The vending machine of claim 4 wherein said sensor is disposed in said plunger assembly.

6. The vending machine of claim 5 wherein said control means samples a signal from said depletion sensor after plunger assembly activation.

7. The vending machine of claim 6 wherein said product depletion sensor includes a microswitch having a first state indicating products are available and a second state indicating that no products are available.

8. The vending machine of claim 7 further comprising:

a carousel motor adapted to rotate said carousel and align each said column with said plunger.

9. The vending machine of claim 8 wherein said control means is responsive to said second microswitch state for initiating a column rotation sequence, wherein said column rotation sequence includes activating said carousel motor to rotate said carousel and align another column with said plunger assembly.

10. The vending machine of claim 9 wherein said control means samples said microswitch state after a column rotation sequence.

11. The vending machine of claim 10 wherein said control means is responsive to said first microswitch state for deactivating said vending machine.

12. The vending machine of claim 11 wherein said control means counts the number of column rotation sequences performed, and stores to memory the total number of column rotation sequences performed.

13. The vending machine of claim 12 wherein said control means is responsive to a predetermined number of column rotation sequences for deactivating said vending machine.

14. The vending machine of claim 12 wherein said control means is responsive to a predetermined number of column rotation sequences for activating means for blocking said coin slot.

15. The vending machine of claim 12 wherein said control means is responsive to a predetermined number of column rotation sequences for activating means for displaying a "sold-out" sign.

16. The vending machine of claim 1 wherein said frame includes a base having a recess between a front edge of said base and a center portion of said base.

17. The vending machine of claim 16 wherein said plunger assembly is includes a plunger disposed within said recess.

18. The vending machine of claim 17 wherein a top surface of said plunger is adapted to be flush with a top surface of said base.

19. The vending machine of claim 18 wherein each said column includes an open bottom portion adapted to allow the product stack to rest on said base top surface and said plunger top surface.

20. The vending machine of claim 19 further comprising means for advancing the carousel for reloading products into each said column.

21. A vending machine comprising:

a first currency slot adapted to accept currency for a product; and a separate currency slot adapted to accept currency for donations.

* * * * *